US005196393A

United States Patent [19]

Kubodera et al.

[11] Patent Number: 5,196,393

[45] Date of Patent: Mar. 23, 1993

[54] HEAT TRANSFER DYE-PROVIDING MATERIAL

[75] Inventors: Seiiti Kubodera; Yoshio Inagaki, both of Kanagawa, Japan

[73] Assignee: Fuji Photo Film Co., Ltd., Kanagawa, Japan

[21] Appl. No.: 781,873

[22] Filed: Oct. 24, 1991

[30] Foreign Application Priority Data

Oct. 26, 1990 [JP] Japan ..... 2-286958
Nov. 2, 1990 [JP] Japan ..... 2-295304

[51] Int. Cl.[5] ..... B41M 5/035; B41M 5/38

[52] U.S. Cl. ..... 503/227; 428/195; 428/913; 428/914; 430/200; 430/201; 430/202; 430/945

[58] Field of Search ..... 428/195, 913, 914; 8/471; 430/200, 201, 202, 945; 503/227

[56] References Cited

U.S. PATENT DOCUMENTS 4,948,778 8/1990 De Boer ..... 503/227
4,973,572 11/1990 De Boer ..... 503/227

*Primary Examiner*—B. Hamilton Hess
*Attorney, Agent, or Firm*—Sughrue, Mion, Zinn, Macpeak & Seas

[57] ABSTRACT

A heat transfer dye-providing material comprising a support and having thereon a layer containing a heat migrating dye, wherein at least one of the dye-containing layer and a layer adjacent thereto contains an infrared-absorbing dye represented by the following Formula (I) or (II):

Formula (I)

Formula (II)

6 Claims, No Drawings

HEAT TRANSFER DYE-PROVIDING MATERIAL

FIELD OF THE INVENTION

The present invention relates to a dye-providing material used for heat transfer induced with a laser, and more specifically to a heat transfer dye-providing material containing a specific infrared-absorbing dye.

BACKGROUND OF THE INVENTION

In recent years, a heat transfer system for preparing a print from an image electronically formed in a color video camera has been developed. In one method for preparing such a print, initially an electronic image is subjected to a color separation with a color filter. Next, the respective color-seperated image are converted to electrical signals. Subsequently, these signals are modulated to generate yellow, magenta and cyan electrical signals, and then these signals are transmitted to a thermal printer. In order to obtain a print, a yellow, magenta or cyan dye-providing material is disposed on an image-receiving material face to face. Then, both are interposed between a thermal head and a platen roller and are heated from the backside of the dye-providing material with a line type thermal head. The thermal head includes numerous heating elements, which are heated one by one in response to the yellow, magenta and cyan electrical signals. Subsequently, this procedure is repeated for the other two colors. Thus, a color hard copy corresponding to an original image visible on the display can be obtained.

In another method of thermally obtaining a print using the electrical signals mentioned above, the thermal head can be replaced with a laser. In this system, the dye-providing material contains a substance capable of intensely absorbing a laser ray. The dye-providing material is irradiated with a laser ray and the absorptive substance converts light energy to thermal energy and immediately transfers the energy to the adjacent dyes, whereby the dyes are heated- to a heating migrating temperature with the dyes being transferred to the image-receiving material. This absorptive substance is present under the dye in a layer and/or is mixed with the dye. A laser beam is modulated with the electric signals corresponding to the shape and color of the original image and only the dyes in the area necessary to be thermally transferred in order to reconstruct the colors of original image are heated for thermal transfer. More detailed explanations of the above process are described in British Patent 2,083,726A, in which the absorptive substance disclosed therein for the laser system is carbon.

The problem in using carbon as the absorptive substance lies in the fact that carbon comprises fine particles and that it tends flocculate in the coating. This deteriorates the quality of a transferred image. Further, carbon is transferred to the image-receiving material due to sticking or abrasion, which results in speckles in the image and insufficient color in the color image.

SUMMARY OF THE INVENTION

An object of the present invention is to provide an absorptive substance without these defects in the prior art.

The above and other objects are achieved by a heat transfer dye-providing material induced with a laser comprising a support and having thereon a layer containing a heat migrating dye, wherein at least one of the dye-containing layer and a layer adjacent thereto contains an infrared-absorbing dye represented by the following Formula (I) or (II):

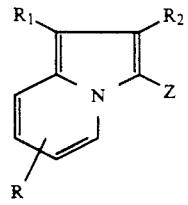

Formula (I)

wherein R represents a hydrogen atom, an alkyl group, an aryl group, an alkoxy group, a halogen atom, or a benzene ring condensed with a pyridine ring; $R_1$ represents an alkyl group or an aryl group; $R_2$ represents a hydrogen atom, an alkyl group, or an aryl group; and Z represents the group of atoms which have a nitrogen atom or an oxygen atom and complete a conjugate chain between the nitrogen atom of the picoline nucleus and the nitrogen atom or the oxygen atom contained in Z;

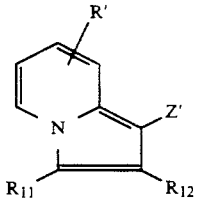

Formula (II)

wherein R' represents a hydrogen atom, a halogen atom, an alkyl group an alkoxy group, an aryl group, or a benzene ring condensed with a pyridine ring; $R_{11}$ and $R_{12}$ represents independently a hydrogen atom, an alkyl group or an aryl group; and Z' represents the group of atoms which have a nitrogen atom or an oxygen atom and complete a conjugate chain between the nitrogen atom of the picoline nucleus and the nitrogen atom or the oxygen atom contained in Z'.

DETAILED DESCRIPTION OF THE INVENTION

Preferable infrared-absorbing dyes having a picoline nucleus (hereinafter referred to as a picoline dye), which can be used in the present invention, are represented by the following Formula (a), (b), (c), (d), (e) or (f):

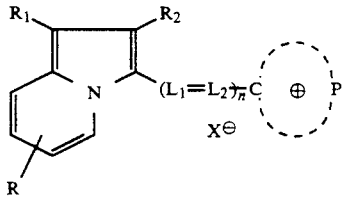

Formula (a)

wherein R, $R_1$ and $R_2$ each have the same meaning as R, $R_1$, and $R_2$, respectively, in Formula (I); $L_1$ and $L_2$ represent a methine group which may be substituted; n represents 1, 2 or 3; P represents the group of atoms necessary to form a hetero ring; and $X^{\ominus}$ represents an anion;

Formula (b)

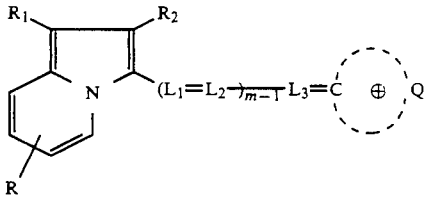

wherein R, $R_1$ and $R_2$ each have the same meaning as R, $R_1$ and $R_2$, respectively, in Formula (I); $L_1$, $L_2$ and $L_3$ represent a methine group which may be substituted; m represents 1, 2 or 3; and Q represents the group of atoms necessary to form a hetero ring;

Formula (c)

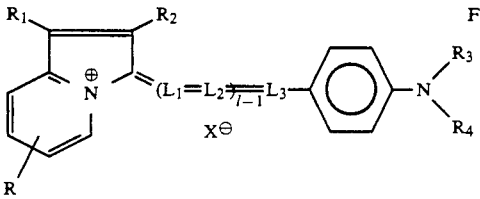

wherein R, $R_1$, and $R_2$ each have the same meaning as R, $R_1$, and $R_2$, respectively, in Formula (I); $L_1$, $L_2$ and $L_3$ represent a methine group which may be substituted; l represents 1 or 2; $R_3$ and $R_4$ represent independently a hydrogen atom, an alkyl group and an aryl group; and $X^{\ominus}$ represents an anion;

Formula (d)

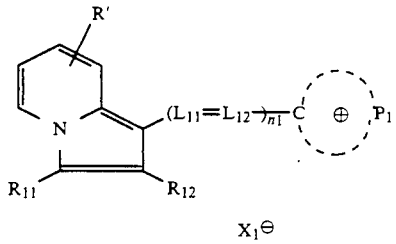

wherein R', $R_{11}$ and $R_{12}$ each have the same meaning as R', $R_{11}$, and $R_{12}$, respectively, in Formula (II); $L_{11}$ and $L_{12}$ represent a methine group which may be substituted; $n_1$ represents 2 or 3; $P_1$ represents the group of atoms necessary to form a 5 to 6-membered hetero ring; and $X_1^{\ominus}$ represents an anion;

Formula (e)

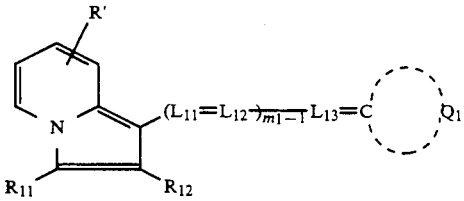

wherein R', $R_{11}$ and $R_{12}$ each have the same meaning as R', $R_{11}$ and $R_{12}$, respectively, in Formula (II); $L_{11}$, $L_{12}$ and $L_{13}$ represent a methine group which may be substituted; $m_1$ represents 2 or 3; and $Q_1$ represents the group of atoms necessary to form a 5 to 6-membered hetero ring;

Formula (f)

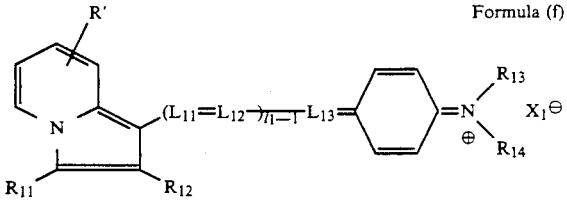

wherein R', $R_{11}$, and $R_{12}$ each have the same meaning as R', $R_{11}$ and $R_{12}$, respectively, in Formula (II); $L_{11}$, $L_{12}$ and $L_{13}$ represent a methine group which may be substituted; $l_1$ represents 2 or 3; $R_{13}$ and $R_{14}$ represent independently a hydrogen atom, an alkyl group and an aryl group; and $X_1^-$ represents an anion.

In the preferred compounds represented by Formulas (a), (b) and (c), R represents a hydrogen atom, an alkyl group having 1 to 20 carbon atoms (for example, methyl, ethyl, butyl, dodecyl, octadecyl and benzyl), an aryl group having 6 to 18 carbon atoms (for example, phenyl, tolyl and p-methoxyphenyl), an alkoxy group having 1 to 18 carbon atoms (for example, methoxy, ethoxy, butoxy, dodecyloxy, and benzyloxy), a halogen atom (for example, fluorine, chlorine, bromine and iodine), or a phenyl group condensed with a pyridine ring (for example, 5,6-benzo condensed ring, 6,7-benzo condensed ring, 7,8-benzo condensed ring).

$R_1$ represents an alkyl group having 1 to 20 carbon atoms (for example, methyl, ethyl, butyl, dodecyl, octadecyl and benzyl), and an aryl group having 6 to 20 carbon atoms (for example, phenyl, p-tolyl and p-methoxyphenyl). $R_2$ represents a hydrogen atom, or an alkyl or aryl group as described for $R_1$ above $R_3$ and $R_4$ represent independently a hydrogen atom, an alkyl group having 1 to 16 carbor atoms (for example, methyl, ethyl, hexyl, ethoxycarbonylmethyl, 2-cyanoethyl, 2-methoxyethyl, 2-chloroethyl, 2-hydroxyethyl. 2-myristoyloxyethyl, benzyl, 4-chlorobenzyl, and 4-isopropylbenzyl), and an aryl group having 6 to 10 carbon atoms (for example, phenyl, naphthyl and 4-tolyl).

$L_1$, $L_2$ and $L_3$ represent a methine group which may be substituted, and examples of suitable substituents are an alkyl group having from 1 to 6 carbon atoms, preferably from 1 to 4 carbon atoms (for example, methyl and ethyl), an aryl group (for example, a phenyl group), and a halogen atom (for example, a chlorine atom). The substituents themselves may be combined to form a 5 to 6-membered ring.

P represents the group of atoms necessary to form a basic heterocyclic ring (for example, indolenine, oxazole, benzoxazole, imidazole, benzimidazole, thiazole, benzothiazole, selenazole, benzoselenazole, naphthoxazole, naphthothiazole, naphthoimidazole, and naphthoindolenine).

Q represents the group of atoms necessary to form a heterocyclic ring capable of becoming an acidic nucleus (for example, indandione, isoxazolone, pyrazolone, barbituric acid, thiobarbituric acid, and hydroxypyridone), or a heterocyclic ring capable of becoming a basic nucleus (for example, pyrrole, indole, and pyrrocoline).

$X^-$ represents an anion and preferred examples thereof are chloride, bromide, iodide, perchlorate, nitrate, acetate, methylsulfate, p-toluenesulfonate, $BF_4^-$, and $PF_6^-$.

Further, in the preferable compounds represented by (d), (e) and (f), R' represents a hydrogen atom, a halogen atom (for example, a chlorine atom and a fluorine atom), an alkyl group having 1 to 10 carbon atoms (for example, methyl, ethyl and butyl), an alkoxy group having 1 to 10 carbon atoms (for example, methoxy, ethoxy, butoxy, and methoxyethoxy), an aryl group having 6 to 20 carbon atoms (for example, phenyl, p-tolyl, m-chorophenyl, and p-methoxyphenyl), or a benzene ring condensed with a pyridine ring (for example, 5,6-benzo condensed ring, 6,7-benzo condensed ring, and 7,8-benzo condensed ring).

$R_{11}$ and $R_{12}$ represent independently a hydrogen atom, an alkyl group having 1 to 10 carbon atoms (for example, methyl, ethyl, butyl, and benzyl), and an aryl group having 6 to 20 carbon atoms (for example, phenyl, p-bromophenyl, p-acetylaminophenyl, p-methoxyphenyl, and p-tolyl).

$L_{11}$, $L_{12}$ and $L_{13}$ represent a methine group which may be substituted, and preferred examples of suitable substituents are an alkyl group having 1 to 4 carbon atoms (for example, methyl and ethyl), a phenyl group, and a halogen atom (for example, a chlorine atom). The substituents of $L_{11}$, $L_{12}$ and $L_{13}$ may be combined to form a 5 to 6-membered ring.

$n_1$, $m_1$ and $l_1$ represent independently an integer of 2 and 3.

$P_1$ represents the group of atoms necessary to form a basic heterocyclic ring (for example, oxazole, benzoxazole, naphthoxazole, thiazole, benzothiazole, naphthothiazole, selenazole, benzoselenazole, indolenine, benzoindolenine, imidazole, and benzimidazole).

$Q_1$ represents the group of atoms necessary to form a heterocyclic ring capable of becoming an acidic nucleus (for example, indandione, isoxazolone, pyrazolone, barbituric acid, thiobarbituric acid, and hydroxypyridone, and pyrrocoline).

$R_{13}$ and $R_{14}$ represent independently a hydrogen atom, an alkyl group having 1 to 10 carbon atoms (for example, methyl, ethyl, hexyl, 2-ethoxycabonylmethyl, 2-chloroethyl, 2-methoxythyl, 2-cyanoethyl, 2-hydroxyethyl, and 2-methanesulfonylaminoethyl); $R_{13}$ and $R_{14}$ may be combined to form a 5 to 6-memberd ring (for example, morpholine and piperidine). $X^-$ represents an anion and preferred examples thereof are $Cl^-$, $Br^-$, $I^-$, $CH_3COO^-$, $CH_3SO_4^-$, $CF_3CO_2^-$, $ClO_4^-$, $BF_4^-$, $PF_6^-$, $HSO_4^-$, and

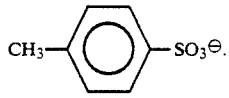

The above described infrared-absorbing dye may be used in any concentration as long as the prescribed object is achieved. In general, excellent results are obtained when it is present in a dye-providing layer or a layer adjacent thereto in an amount of 0.04 to 0.5 g/m$^2$.

Spacer beads may be used on the dye-providing layer as a separating layer in order to separate the dye-providing material from the image-receiving material and to thereby increase the uniformity of dye transfer and density of an image.

Suitable examples of infrared absorbing dyes which can be used in the present invention are shown below but the invention is-not to be construed as being limited thereto.

1

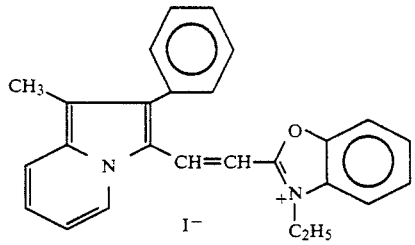

2

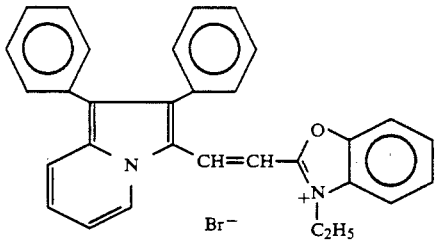

3

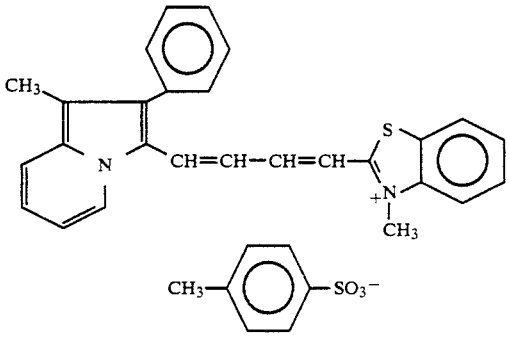

-continued
4
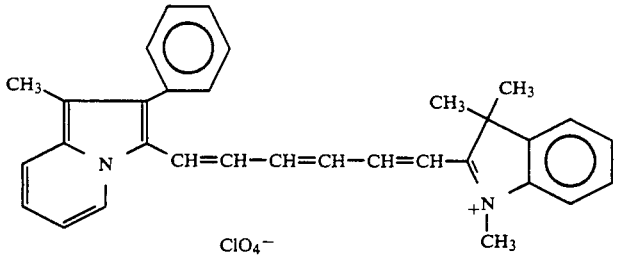
5
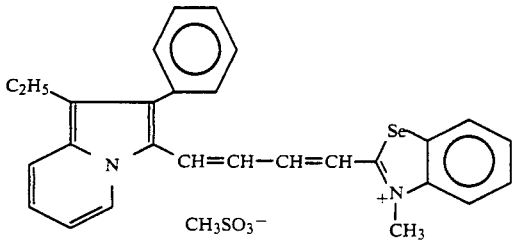
6
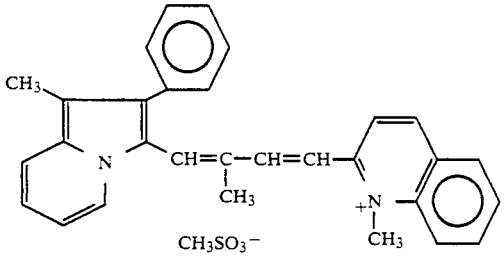
7
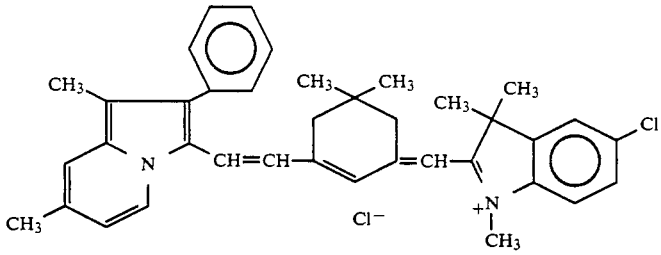
8
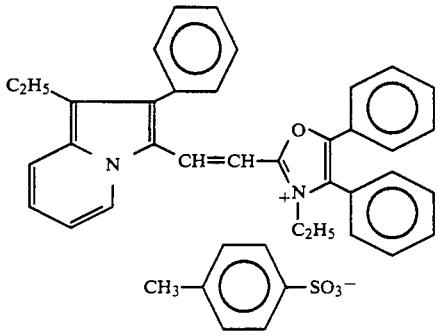

-continued
9
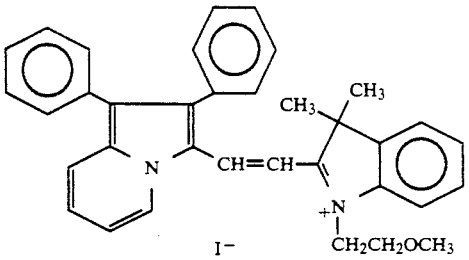
10
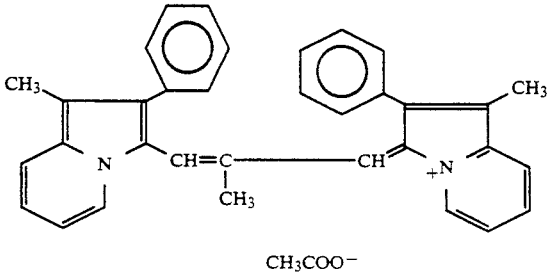
11
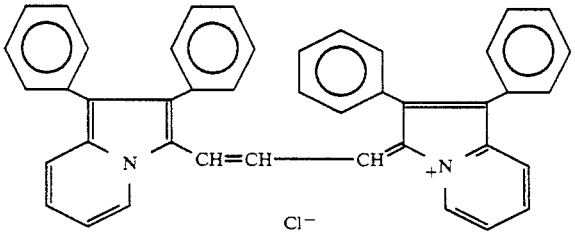
12
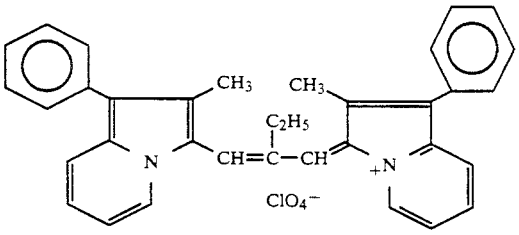
13
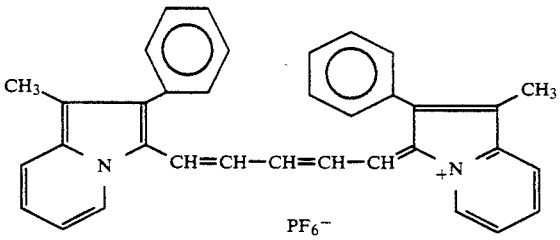
14
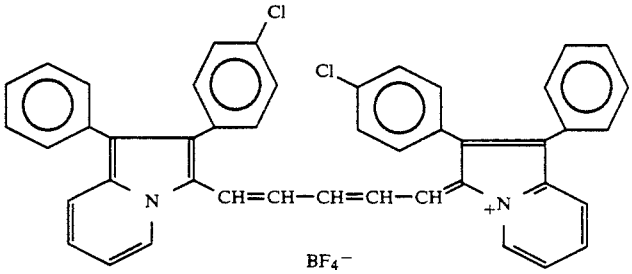

-continued
15
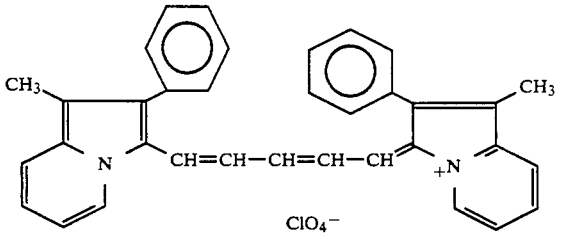
16
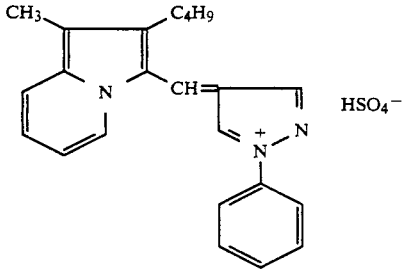
17
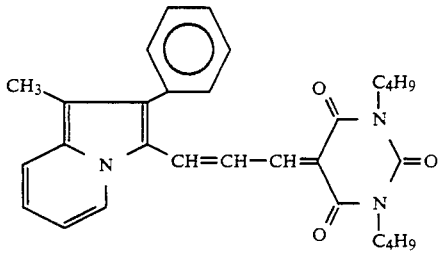
18
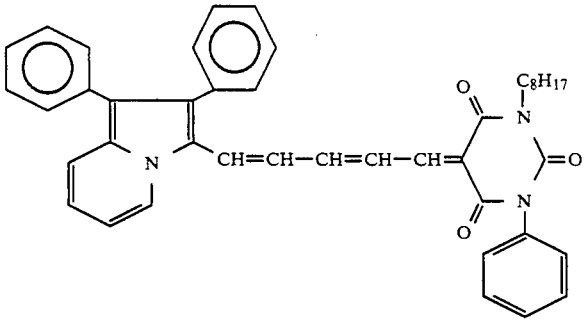
19
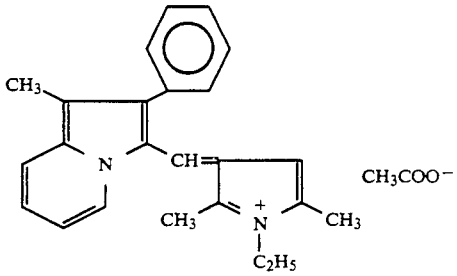

-continued
20
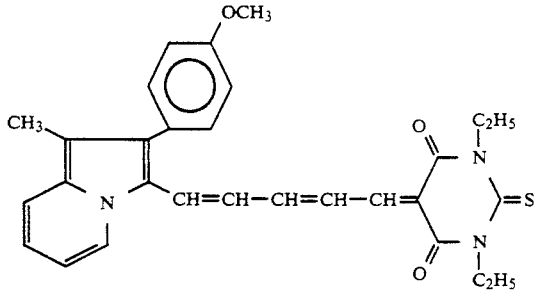
21
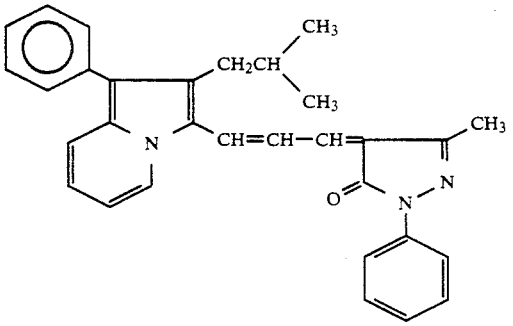
22
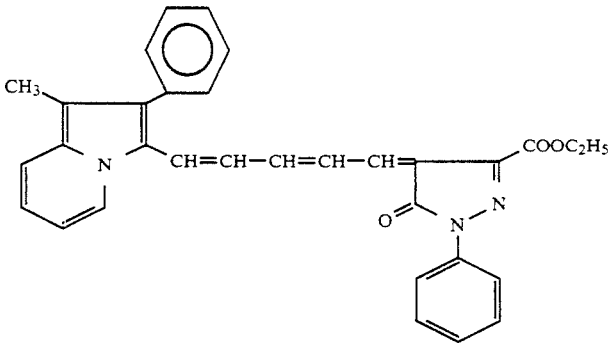
23
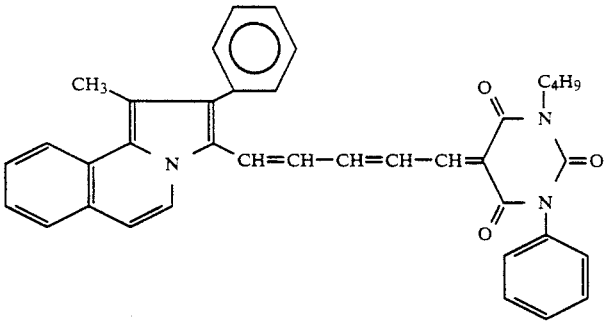
24
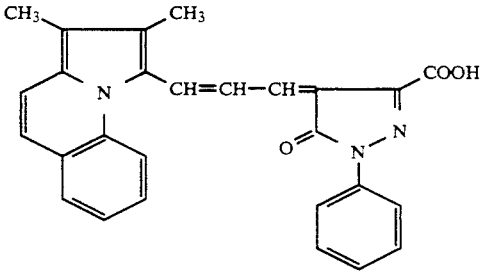

-continued
25
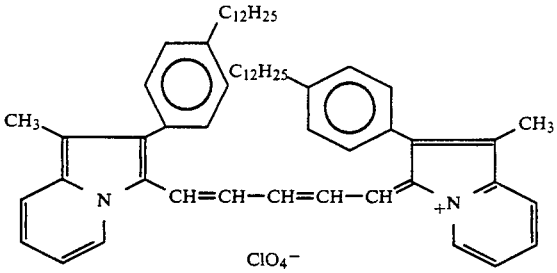
26
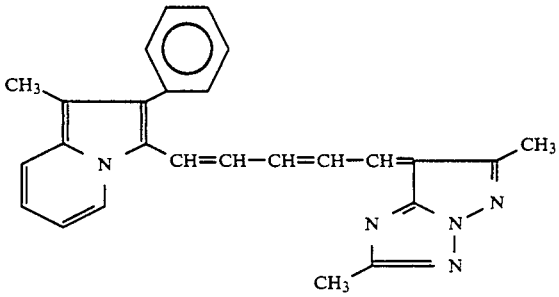
27
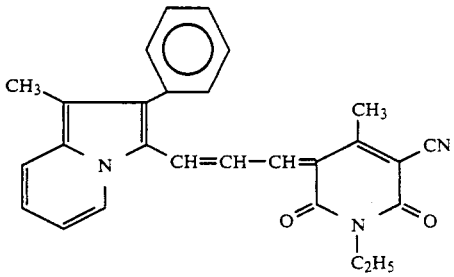
28
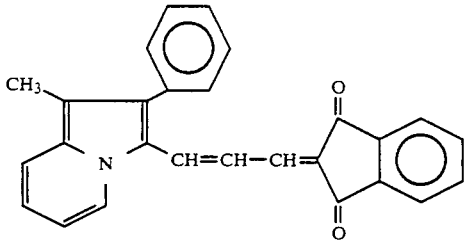
29
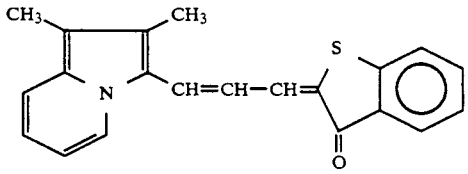
30
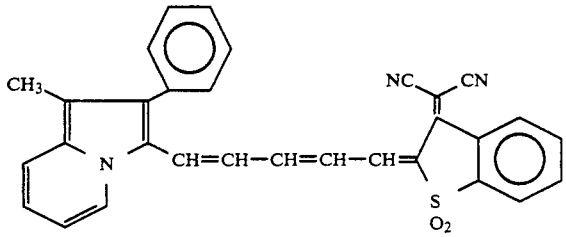

-continued
31
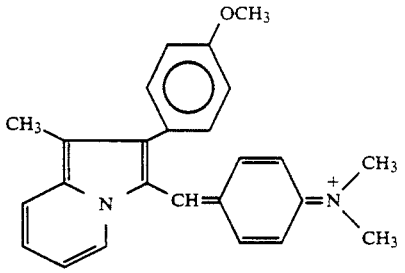
32
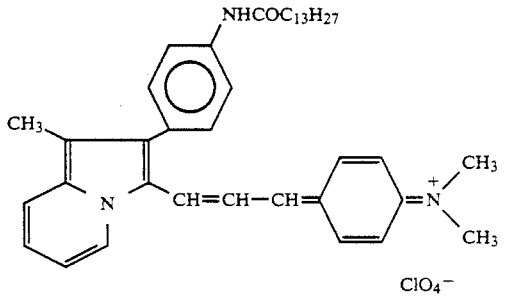
33
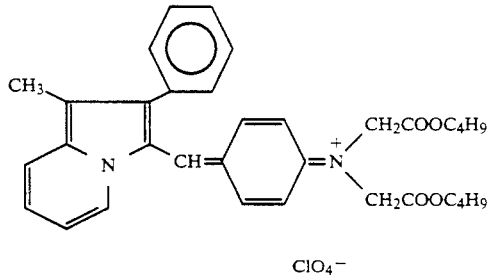
34
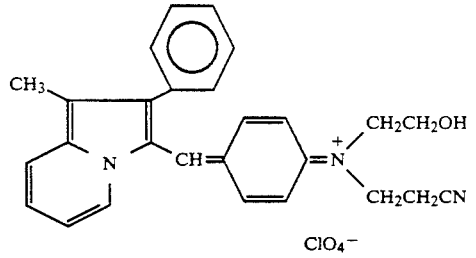
35
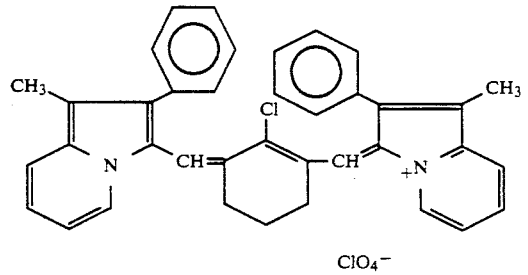

-continued
36
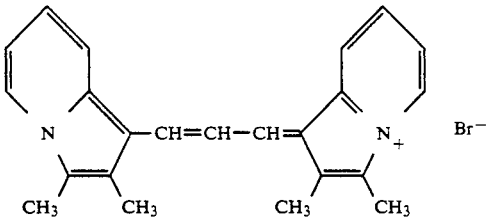
37
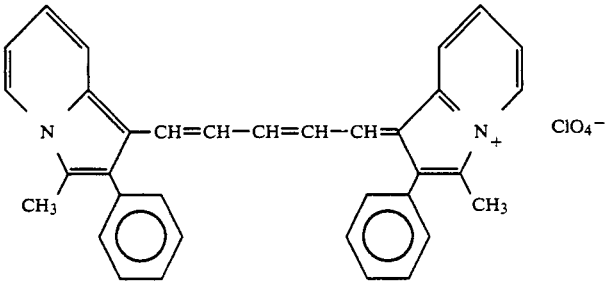
38
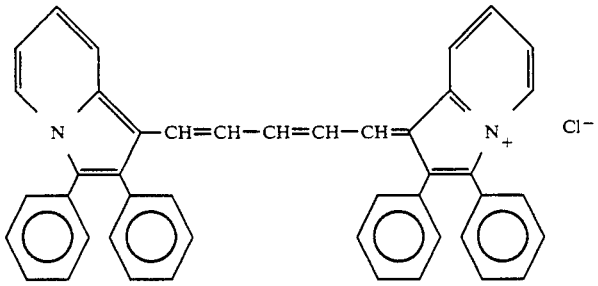
39
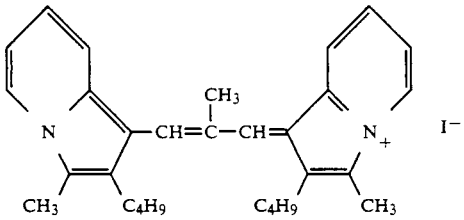
40
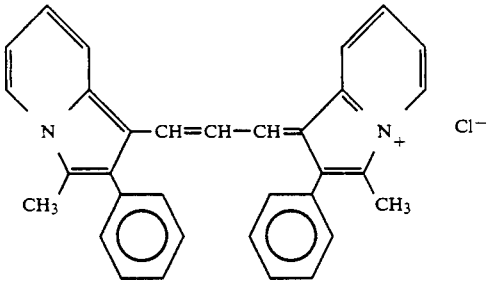
41
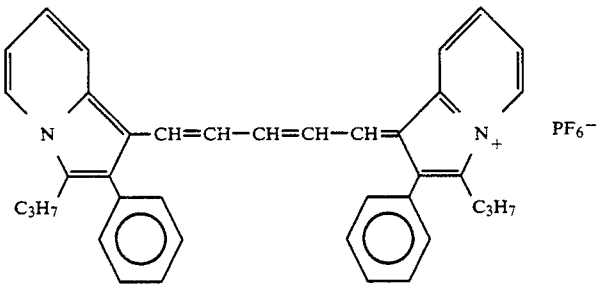

-continued
42
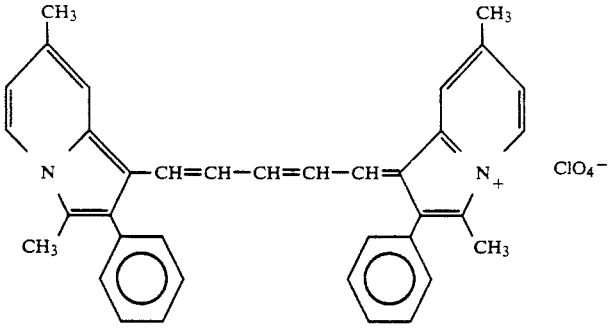
43
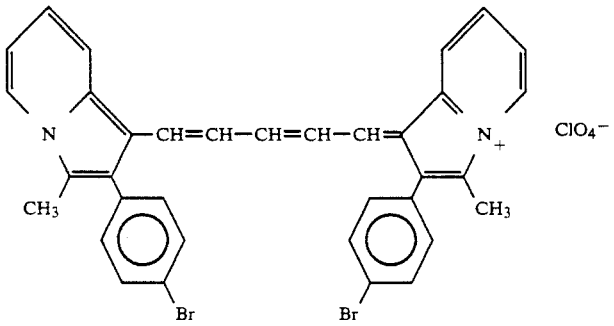
44
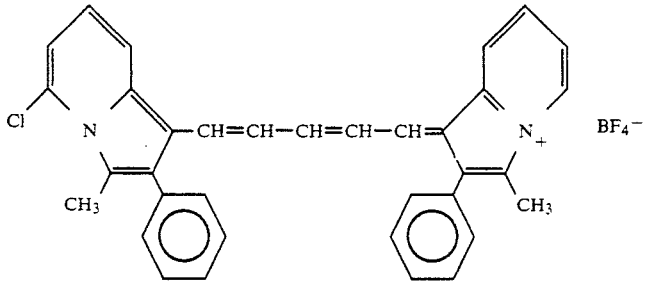
45
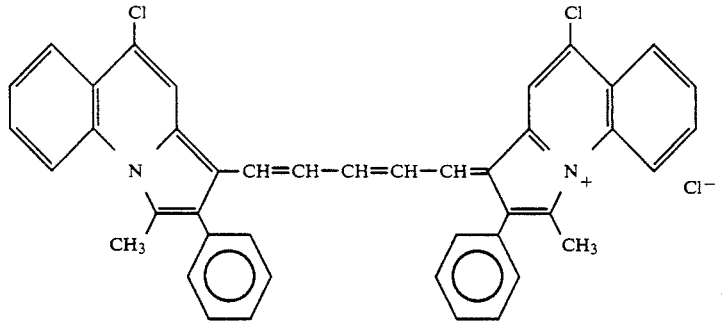
46
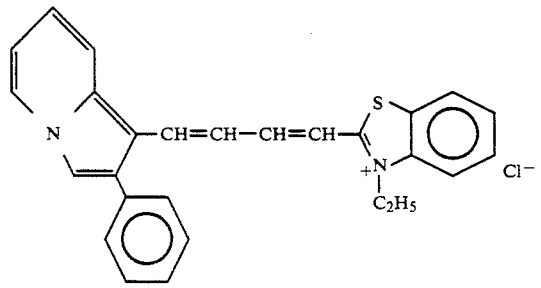

-continued
47
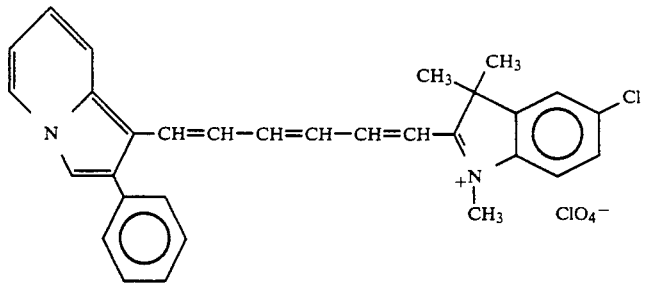
48
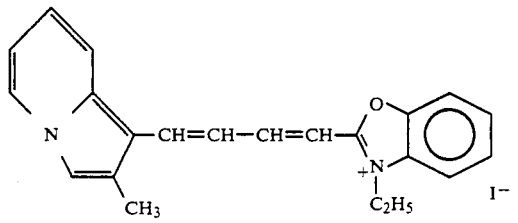
49
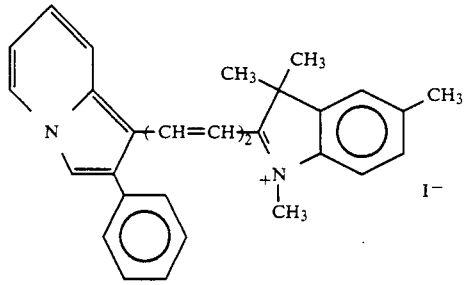
50
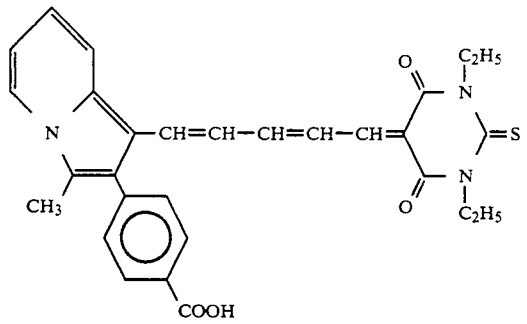
51
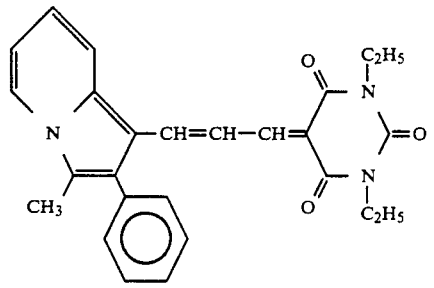

-continued
52
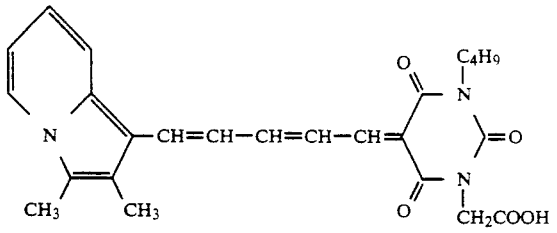
53
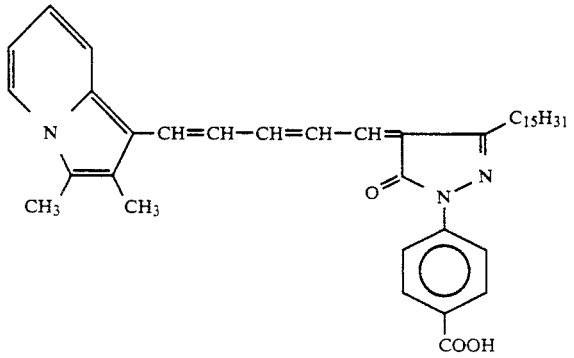
54
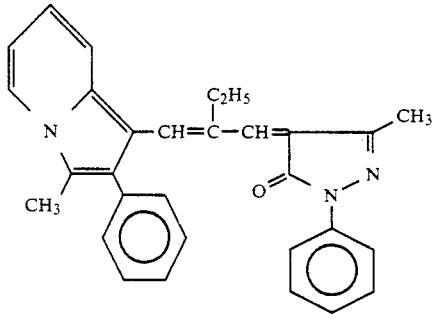
55
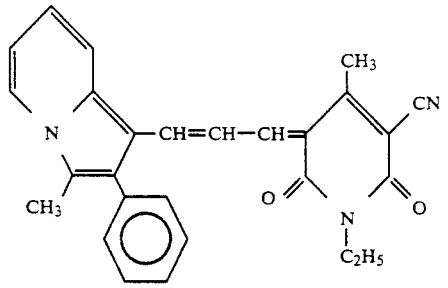
56
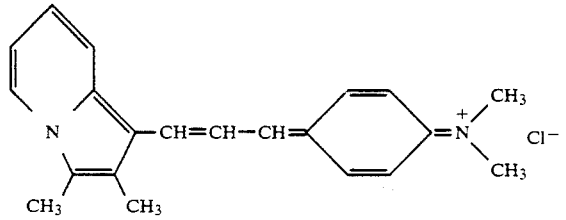

-continued
57
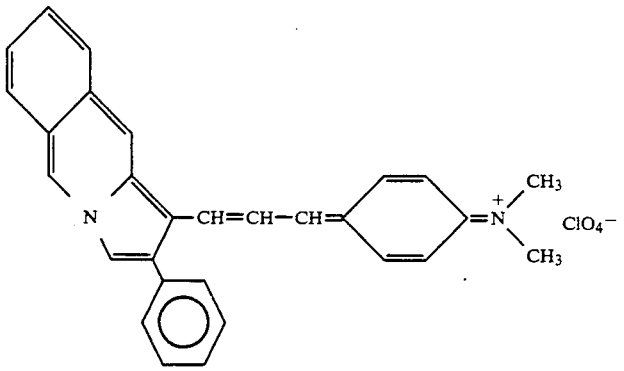
58
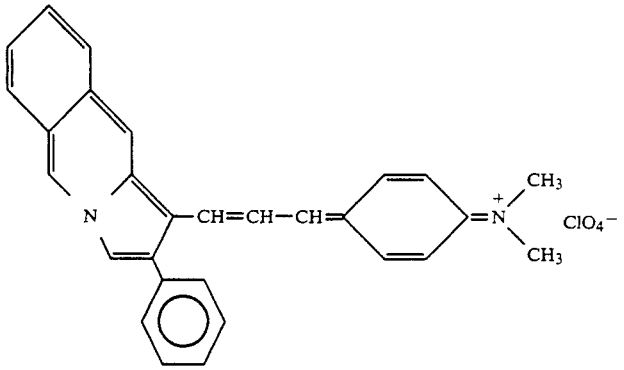
59
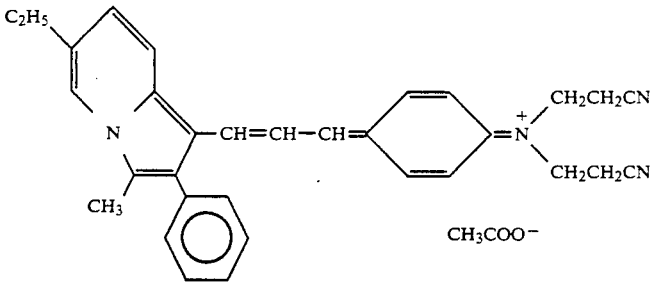
60
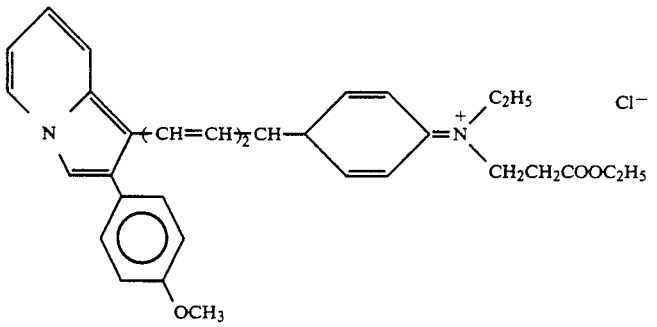

-continued

61

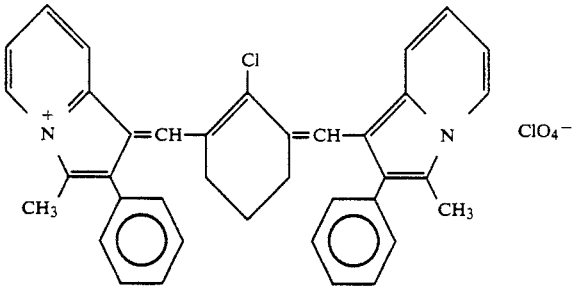

62

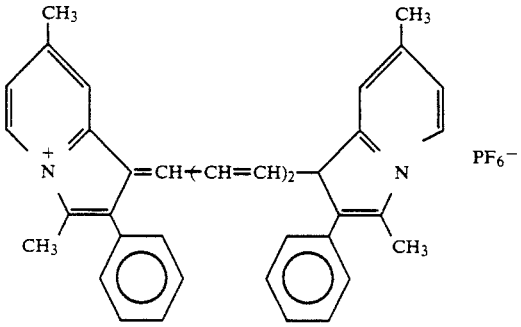

63

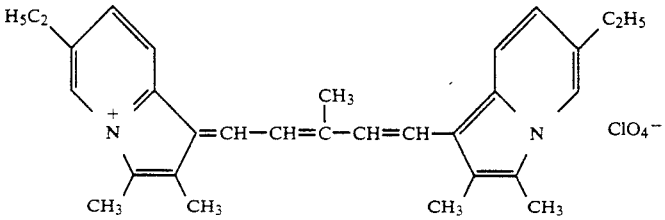

64

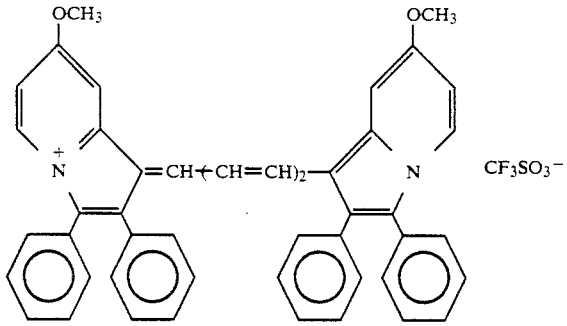

65

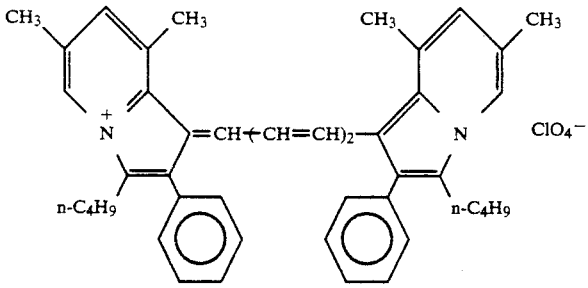

The pyrrocoline dye used in the present invention as the infrared absorbing dye can be synthesized according to the method described in W. L. Mosby, *Heterocyclic Systems with Bridqe-Head Nitrogen Atoms*, Part One, Interscience Publishers, 1961, or using the method described in U.S. Pat. No. 3,260,601.

Representative synthetic examples of the synthesis of pyrrocoline dyes which can be used in the present invention are shown below. Unless otherwise indicated, all parts, percents, ratios and the like are by weight.

SYNTHESIS EXAMPLE 1 (Compound 15)

To 30 ml of methanol were added 2.5 g of 1-methyl-2-phenylpyrrocoline and 1.7 g of 1,7-diaza-1,3,5-heptatriene, and the solution was heated to 50° C. with stirring. Then, 1 ml of acetic anhydride was added and the solution was heated at 50° to 60° C. for two hours. After cooling the solution to room temperature (about 20° to 30° C.), 3 ml of the 60% aqueous solution of perchloric acid was added dropwise and the precipitated crystals were filtered out and washed with ethanol, followed by drying to obtain 2.3 g of Compound 15.

Melting point: 231° to 232° C.

$\lambda_{max}^{MeOH}$: 810 nm.

SYNTHESIS EXAMPLE 2 (COMPOUND 11)

To 50 ml of ethanol were added 2.7 g of 1,2-diphenylpyrrocoline and 1.5 ml of β-methoxyacrolein, and further, 1.5 ml of concentrated hydrochloric acid was added, followed by heating at 40° to 50° C. for 30 minutes. After cooling the solution, the precipitated crystals were filtered out and washed with methanol, followed by drying to obtain 1.7 g of Compound 11.

Melting point: 232° to 235° C. (decomposed).

$\lambda_{max}^{MeOH}$: 708 nm.

SYNTHESIS EXAMPLE 3 (COMPOUND 40)

With 15 ml of ethanol were mixed 2.1 g of 2-phenyl-3-methylpyrrocoline and 1.5 ml of 1,3,3-trimethoxypropene and the mixture was heated to 40° C. for dissolution. To this mixture was added 1.5 ml of concentrated hydrochloric acid and the mixture was heated at reflux for 10 to 15 minutes. The reaction mixture was cooled to 0° C. to obtain precipitated crystals. The crystals were washed with cold ethanol and dried to obtain 2.2 g of Compound 40.

Melting point: 201° to 203° C.

$\lambda_{max}^{MeOH}$: 655 nm.

SYNTHESIS EXAMPLE 4 (COMPOUND 37)

To 30 ml of methanol added were 2.5 g of 2-phenyl-3-methylpyrrocoline and 1.7 g of glutaconic dialdehydediaryl hydrochloric acid salt with stirring. After adding dropwise 3 ml of acetic anhydride to this mixture, it was heated at reflux for about 30 minutes. Then, the mixture was cooled to 0° C. and 3 ml of a 65% (by weight) aqueous solution of perchloric acid were added dropwise to obtain precipitated crystals. The crystals were washed with methanol and dried to obtain 2.8 g of Compound 37.

Melting point: 210° to 213° C.

$\lambda_{max}^{MeOH}$: 748 nm.

ConventiOnal materials can be used for the support of the heat transfer dye-providing material of the present invention. Suitable examples thereof include polyethylene terephthalates, polyamides, polycarbonates, glassine paper, condenser paper, cellulose esters, fluorinated polymers, polyethers, polyacetals, polyolefins, polyimides, polyphenylene sulfides, polypropylenes, polysulfones, and cellophanes.

The thickness of the support for the heat transfer dye-providing material is generally 2 to 30 μm. A subbing layer may be provided on the support, if desired.

The heat transfer dye-providing material containing a heat migrating dye comprises basically a support and has thereon a dye-providing layer containing a dye which becomes mobile on heating and a binder. This heat transfer dye-providing material can be prepared by applying a coating solution on one side of a conventional support for the heat transfer dye-providing material as described above in an amount which provides a dry thickness of, for example, about 0.2 to 5 μm, preferably 0.4 to 2 μm, to thereby form a dye-providing layer. The coating solution can be prepared by dissolving or dispersing a conventional dye which sublimes or becomes mobile on heating and a binder in an appropriate solvent.

The solvents for dissolving or dispersing the above-described dye and binder can be conventional ink solvents, and examples of such solvents include an alcohol such as methanol, ethanol, isopropyl alcohol, n-butanol and isobutanol, a ketone such as methyl ethyl ketone, methyl isobutyl ketone and cyclohexanone, an aromatic solvent such as toluene and xylene, a halogenated hydrocarbon such as dichloromethane and trichloroethane, dioxane, tetrahydrofuran and the like, and a mixture thereof.

The dye-providing layer may comprise a single layer structure, or of a structure comprising two or more layers so that the heat transfer dye-providing material can be applied in the manner in which it is repeatedly used over many times, and the respective layers may have the different dye contents and dye/binder ratios.

Any of the dyes which are conventionally used for a heat transfer dye-providing material can be used as dyes useful for forming such dye-providing layer in the present invention. Of these dyes, the dyes having a molecular weight as small as about 150 to 800 are particularly preferred in the present invention. The dyes are selected considering characteristics such as transfer temperature, hue, light fastness, dissolving property and dispersibility in an ink and in a binder.

Suitable specific examples of dyes are dispersion dyes, basic dyes and oil-soluble dyes. Preferred specific examples of suitable dyes which can be used are Sumikaron Yellow E4GL, Dianix Yellow H2G-FS, Miketon Polyester Yellow 3GSL, Kayaset Yellow 937, Sumikaron Red EFBL, Dianix Red ACE, Miketon Polyester Red FB, Kayaset Red 126, Miketon Fast Brilliant Blue B, and Kayaset Blue 136.

Further, a yellow dye represented by the following Formula (Y) can be advantageously used.

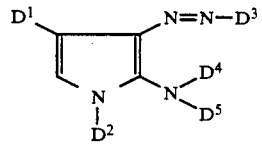

(Y)

wherein $D^1$ represents a hydrogen atom, an alkyl group, an alkoxy group, an aryl group, an alkoxycarbonyl group, a cyano group, or a carbamoyl group; $D^2$ represents a hydrogen atom, an alkyl group, or an aryl group; $D^3$ represents an aryl group or a heteroaryl group; $D^4$ and $D^5$ each represents a hydrogen atom and an alkyl group; and each of the above groups may be substituted.

Specific examples of yellow dyes of the formula (Y) are shown below.

Y-1
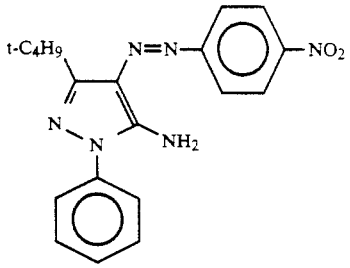
Y-2
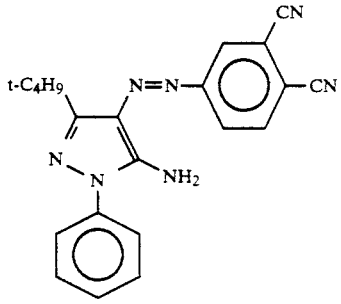
Y-3
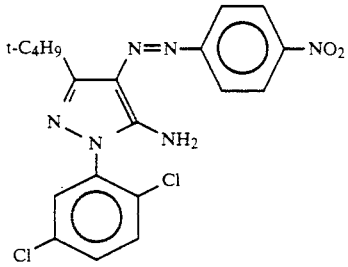
Y-4
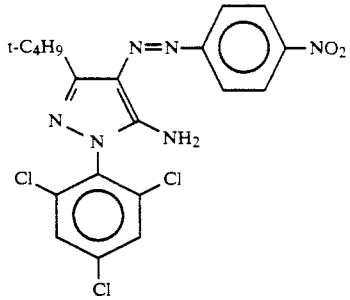
Y-5
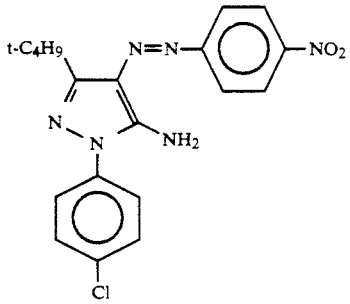
-continued
Y-6
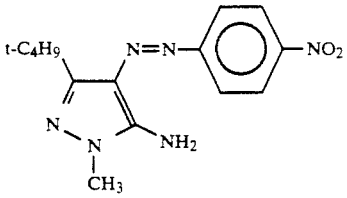
Y-7
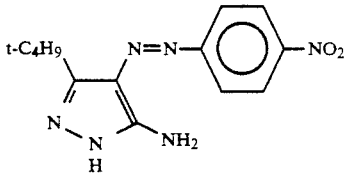
Y-8
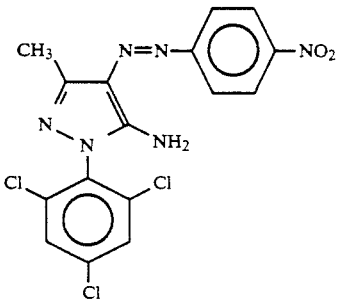
Y-9
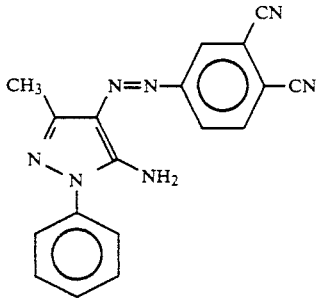
Y-10
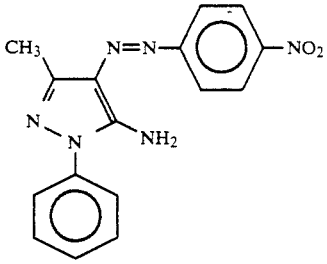
Y-11
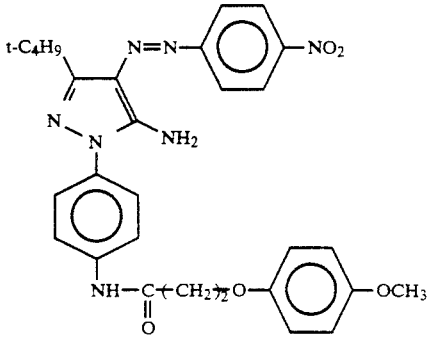

The magenta dyes represented by the following formula (M) can be advantageously used:

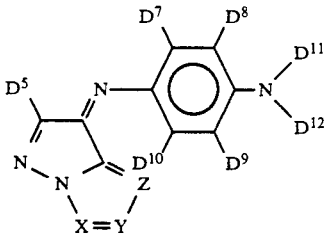

(M)

wherein $D^6$ to $D^{10}$ each represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^{11}$ and $D^{12}$ each represent a hydrogen atom, an alkyl group, or an aryl group, and $D^{11}$ and $D^{12}$ may be combined with each other to form a ring and $D^8$ and $D^{11}$ and/or $D^9$ and $D^{12}$ may be combined with each other to form a ring; X, Y and Z each represent a nitrogen atom or $$=\overset{\overset{D^{13}}{|}}{C}-,$$

in which $D^{13}$ represents a hydrogen atom, an alkyl group, an aryl group, an alkoxy group, an aryloxy group, or an amino group, provided that when X and Y or Y and Z are $$=\overset{\overset{D^{13}}{|}}{C}-,$$

two $D^{13}$ may be combined with each other to form a saturated or unsaturated carbon ring; and each of the above groups may be substituted.

Specific examples of magenta dyes of the formula (M) which can be used are shown below;

M-1

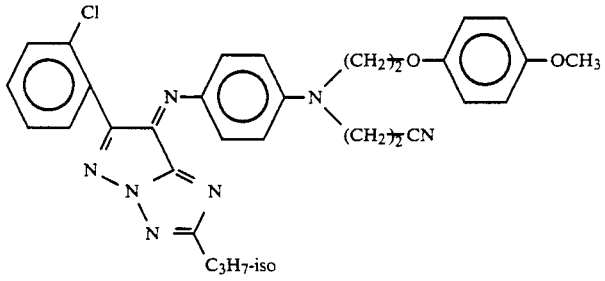

M-2

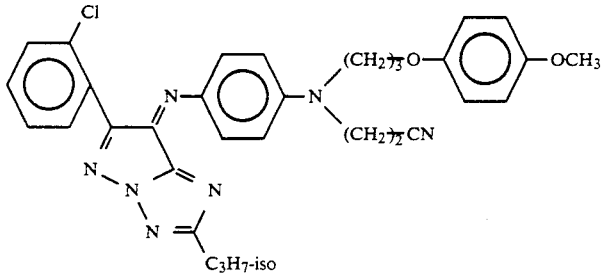

M-3

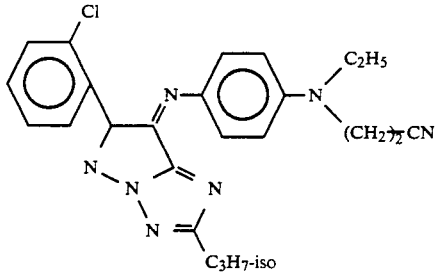

M-4

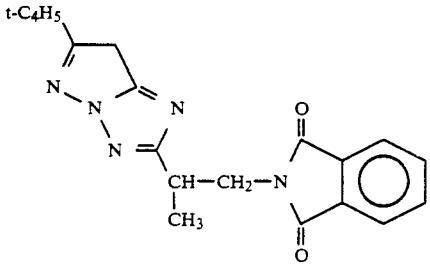

-continued
M-5
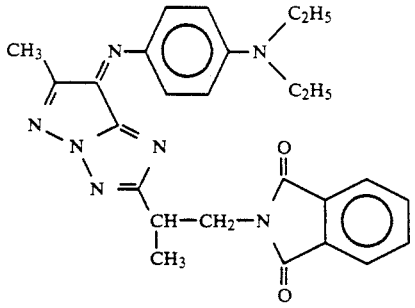
M-6
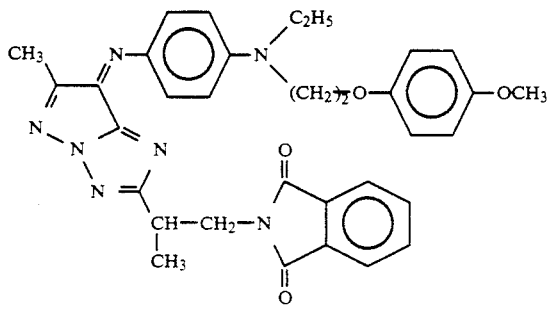
M-7
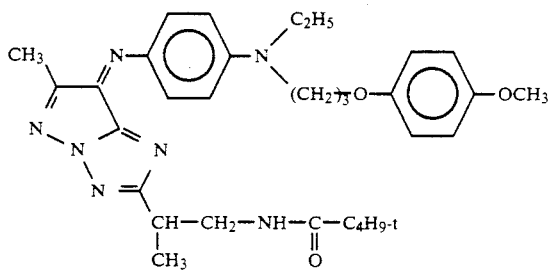
M-8
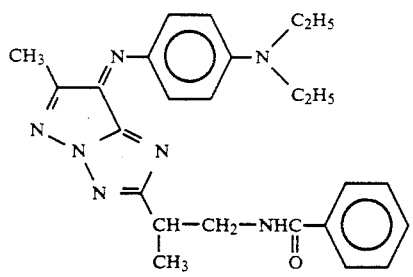
M-9
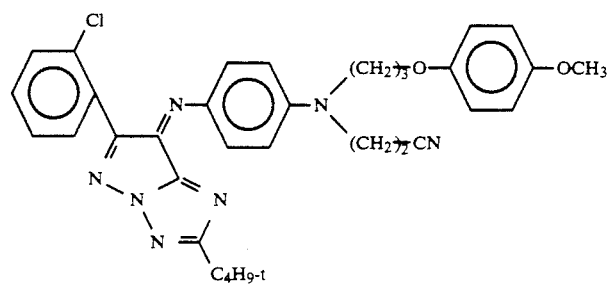

-continued
M-10
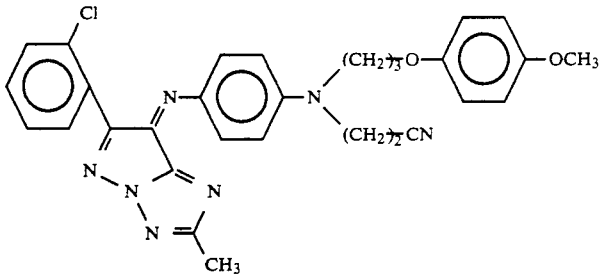
Cyan dyes represented by the following Formula (C) can be advantageously used.
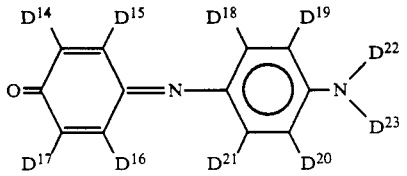
(C)
wherein $D^{14}$ and $D^{21}$ each have the same meaning as $D^{6}$ to $D^{10}$; and $D^{22}$ and $D^{23}$ each have the same meaning as $D^{11}$ and $D^{12}$.
Suitable specific examples of cyan dyes of the formula (C) are shown below:
C-1
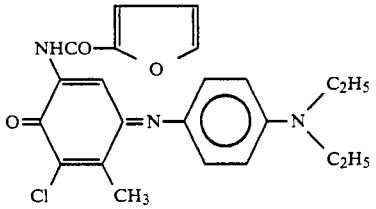
C-2
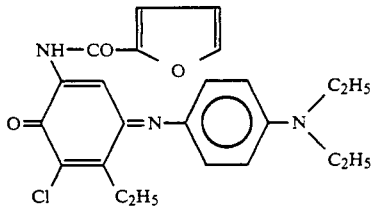
C-3
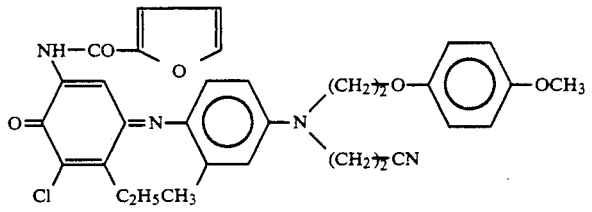
C-4
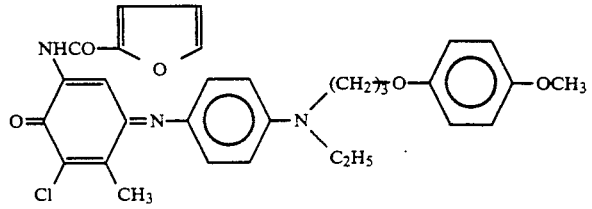

-continued

C-5

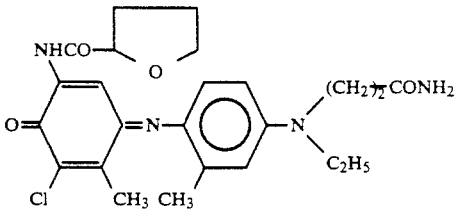

C-6

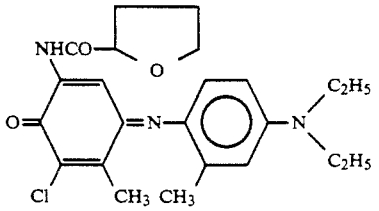

C-7

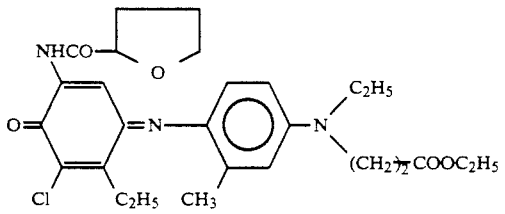

C-8

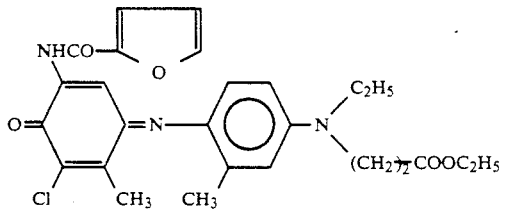

C-9

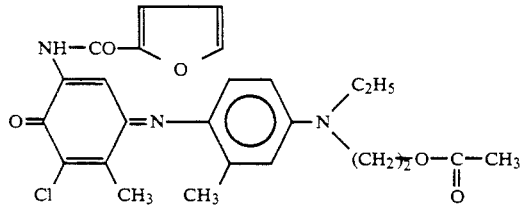

The compounds in which an anti-fading group as described in European Patent 423,796A is present in the compounds represented by above Formulas (Y), (M) and (C) are preferably because light fastness can be improved.

Any conventional binder resins known can be used as binder resins also in the present invention in combination with the above dyes. Usually, binder resins which have a high heat resistance and, in addition, do not prevent the dyes from transferring on heating are selected. Specific examples of resins which can be used in the present invention are a polyamide resin, a polyester resin, an epoxy resin, a polyurethane resin, a polyacrylic resin (for example, polymethyl methacrylate, polyacrylamide, and polystyrene-2-acrylonitrile), a vinyl resin including polyvinylpyrrolidone, a polyvinylchloride resin (for example, a copolymer of vinylchloride-vinyl acetate), a polycarbonate resin, polystyrene, polyphenylene oxide, a cellulose resin (for example, methylcellulose, ethylcellulose, carboxymethylcellulose, cellulose acetate biphthalate, cellulose acetate, cellulose acetate propionate, cellulose acetate butyrate, and cellulose triacetate), a polyvinyl alcohol resin (for example, polyvinyl alcohol and a partially saponified polyvinyl alcohol such as polyvinyl butyral), a petroleum resin, a rosin derivative, a cumarone-indene resin, a terpene resin, and a polyolefin resin (for example, polyethylene and polypropylene).

These binder resins are used preferably in a ratio of about 80 to 500 parts by weight per 100 parts by weight of the yellow, magenta and cyan dye.

In the present invention, conventional ink solvents can be appropriately used as the ink solvent for dissolving or dispersing the above dyes and the binder resin. Suitable examples of the ink solvent include an alcohol such as methanol, ethanol, isopropyl alcohol, n-butanol and isobutanol, a ketone such as methyl ethyl ketone, methyl isobutyl ketone and cyclohexanone, an aromatic solvent such as toluene and xylene, a halogenated hydrocarbon solvent such as dichloromethane and trichloroethane, dioxane, tetrahydrofuran and the like, and a mixture thereof.

The dye-providing material may be provided with a hydrophilic barrier layer in order to prevent the dyes from diffusing toward the support, if desired. Such a hydrophilic dye-barrier layer contains a hydrophilic compound. In general, excellent results can be obtained using gelatin, polyacrylamide, polyisopropylacrylamide, butyl methacrylate-grafted gelatin, ethyl methacrylate-grafted gelatin, cellulose monoacetate, methyl cellulose, polyvinyl alcohol, polyethyleneimine, polyacrylic acid, a mixture of polyvinyl alcohol and polyvinyl acetate, a mixture of polyvinyl alcohol and polyacrylic acid, and a mixture of cellulose monoacetate and polyacrylic acid. Of these materials, polyacrylic acid, cellulose monoacetate and polyvinyl alcohol are particularly preferred.

The dye-providing material may also include a subbing layer. In the present invention, any materials for the subbing layer can be used as long as they can act as a subbing material. Preferred examples thereof are a copolymer of acrylonitrile, vinylidene chloride and acrylic acid (14:80:6 by weight), a copolymer of butyl acrylate, 2-aminoethyl methacrylate and 2-hydroxyethyl methacrylate (30:20:50 by weight), a linear, saturated polyester, for example, Bostic 7650 manufactured by Emhart Co., Bostic Chemical group, and a chlorinated high-density polyethylenetrichloroethylene resin. The amount of the subbing layer coated is not specifically limited but usually is about 0.1 to 2.0 g/m$^2$.

In the dye-providing layer, the dye is selected so that transfer can be carried out at a prescribed hue on printing and if necessary, two or more dye-providing layers each containing a different dye may be formed in order on the heat transfer dye-providing material. For example, where printing of each color is repeated depending on the signals of the separated colors to form an image similar to a color photo, the hue of a printed image comprises preferably cyan, magenta and yellow colors. Thus, three dye-providing layers containing dyes capable of providing these hues are used. In addition to cyan, magenta and yellow dye-providing layers, a dye-providing layer containing a dye capable of giving a black color may be present.

It is preferred to provide the dye-providing material with a mark for detecting a position. The mark is preferably formed by multi-color gravure printing simultaneously with the formation of the dye-providing layers on the supports. The mark can be any material as long as it can be detected by an electric, magnetic or optical means as disclosed in JP-A-1-202491.

In the present invention, the support used for a heat transfer image-receiving material may be any suitable support material which can endure the transfer temperature used and satisfy the requirements of smoothness, whiteness, sliding property, friction property, anti-electrification, and freedom from dimple formation after transfer. Specific examples thereof are paper supports such as synthetic paper (e.g., synthetic papers of polyolefin and polystyrene), a woodfree paper, an art paper, a coated paper, a cast-coated paper, a wall paper, a backing paper, a synthetic resin or emulsion-impregnated paper, a synthetic rubber latex-impregnated paper, a synthetic resin-lining paper, a board paper, a cellulose fiber paper, and -a polyolefin-coated paper (in particular, a paper coated on both sides with polyethylene); various synthetic resin films or sheets of polyolefin, polyvinyl chloride, polyethylene terephthalate, polystyrene, polymethacrylate, and polycarbonate, and films or sheets thereof each treated to achieve a white color reflectiveness; and laminated materials comprising combinations of the above described materials.

The heat transfer image-receiving material includes an image-receiving layer. This image-receiving layer is preferably a layer which contains, alone or in combination with the other binders, a substance capable of receiving a heat migrating dye which migrates from the heat transfer dye-providing material on printing and which has the function of fixing the dye therein. The thickness thereof is preferably about 0.5 to 50 μm.

Examples of polymers which are typical substances capable of receiving the heat migrating dyes are set forth below.

(1) Polymers with an ester bond:

A polyester resin obtained by condensing a dicarboxylic acid component such as terephthalic acid, isophthalic acid and succinic acid (these dicarboxylic acid components may be substituted with a sulfonic acid group and a carboxylic acid group) with a dihydric alcohol component such as- ethylene glycol, diethylene glycol, propylene glycol, neopentyl glycol and bisphenol A; a polyacrylate resin and a polymethacrylate resin such as polymethyl methacrylate, polybutyl methacrylate, polymethyl acrylate and polybutyl acrylate; a polycarbonate resin; a polyvinyl acetate resin; a styreneacrylate resin; and a vinyltoluene-acrylate resin. Examples thereof are described in greater detail in JP-A-59-101395 (the term "JP-A" as used herein means an "unexamined published Japanese patent application"), JP-A-63-7971, JP-A-63-7972, JP-A-63-7973, and JP-A-60-294862. Commercially available products include Vylon 290, Vylon 200, Vylon 280, Vylon 300, Vylon 103, Vylon GK-140, and Vylon GK-130 each manufactured by Toyobo Co., Ltd., and ATR-2009 and ATR-2010 each manufactured by Kao Corporation.

(2) Polymers with a urethane bond such as a polyurethane resin.

(3) Polymers with an amide bond such as a polyamide resin.

(4) Polymers with a urea bond such as a urea resin.

(5) Polymers with a sulfone bond such as a polysulfone resin.

(6) Other polymers with a high-polar bond such as a polycaprolactone resin, a styrene-maleic anhydride resin, a polyvinyl chloride resin, and a polyacrylonitrile resin.

In addition to the above described synthetic resins, a mixture of these polymers or copolymers thereof can be used as well.

A high boiling solvent of a hot-melt solvent can be incorporated into the image-receiving layer as the substance capable of receiving the heat migrating dye or as a dispersion aid.

Typical examples of high boiling solvents and hot-melt solvents which can be used are the compounds described in JP-A-62-174754, JP-A-62-245253, JP-A-61-209444, JP-A-61-200538, JP-A-62-8145, JP-A-62-9348, JP-A-62-30247, and JP-A-62-136646.

The image-receiving layer of the heat transfer image-receiving material of the present invention may have a structure in which the substance capable of receiving the heat migrating dye dispersed in a water soluble binder is employed. Suitable water-soluble binders used in this case may be various conventional polymers. Water-soluble polymers having the group capable of crosslinking with a hardener are preferable. Of these water soluble polymers, gelatins are particularly preferable.

The image-receiving layer may be composed of two or more layers, wherein the layer closer to the support preferably has a structure in which a synthetic resin with a lower glass transition point, a high-boiling solvent and a hot-melt solvent is used to increase the adhesiveness to a dye; and the layer farther from the support has a structure in which a synthetic resin with a higher glass transition point is used and a high-boiling solvent and a hot-melt solvent are used, in a necessary minimum amount or not used at all, to prevent problems such as adhesiveness to surfaces, sticking to the other materials, retransfer to other materials after transfer, and blocking due to the heat transfer dye-providing material.

The total thickness of the image-receiving layer is preferably about 0.5 to 50 μm, particularly preferably 3 to 30 μm. Where the image-receiving layer has a two layer structure, the thickness of the outermost layer is preferably about 0.1 to- 2 μm, particularly 0.2 to 1 μm.

In the present invention, the heat transfer image-receiving material may include an intermediate layer between the support and an image-receiving layer.

The intermediate layer has one or more functions as a cushion layer, a porous layer and a dye diffusion-preventing layer, and in certain occasions, it also functions as an adhesive.

The dye diffusion-preventing layer has the function, in particular, of preventing the heat migrating dye from diffusing to the support. The binder of this diffusion-preventing layer may be either water-soluble or organic solvent-soluble. A water soluble binder is preferable and examples thereof are the same as those described as binders for the image-receiving layer. Of these water soluble binders, gelatin is particularly preferable.

The porous layer has the function of preventing the heat applied during heat transfer from diffusing to the support to efficiently utilize the applied heat.

In the present invention, an image-receiving layer, a cushion layer, a porous layer, a diffusion-preventing layer and an adhesive layer, each forming the heat transfer image-receiving material may contain fine powders such as silica, clay, talc, diatomaceous earth, calcium carbonate, calcium sulfate, barium sulfate, aluminium silicate, synthetic zeolite, zinc oxide, lithopone, titanium oxide, and alumina.

A fluorescent whitening may also be used for the heat transfer image-receiving material. Suitable examples thereof are the compounds described in K. Veenkataraman, ed. *The Chemistry of Synthetic Dyes,* Vol. 5, Chapter 8, and JP-A-61-143752. Specific examples of these fluorescent whitening agents are a stilbene compound, a coumarin compound, a biphenyl compound, a benzoxazolyl compound, a naphthalimide compound, a pyrazoline compound, a carbostyryl compound, and 2,5-dibenzozaolethiophene compound.

A fluorescent whitening agent can be used in combination with an anti-fading agent, if desired.

In the present invention, in order to improve the releasing property of the heat transfer dye-providing material from the heat transfer image-receiving material, a releasing agent is incorporated preferably into the layers of the dye-providing material and/or the image-receiving material, particularly preferably into the outermost layers of the two materials which come into contact with each other.

Examples of suitable releasing agents include any of the conventional agents such as solid or wax substances including fine powders of polyethylene wax, amide wax and silicon resins, and fine powders of fluorinated resins, fluorine type and phosphate type surfactants; and paraffin oils, silicone oils and fluorine oils. Of them a silicone oil is particularly preferred.

Suitable silicone oils which can be used include carboxy modified, amino modified, epoxy modified, polyether modified, and alkyl modified silicone oils, in addition to the non-modified silicone oils. They can be used alone or as a combination of two or more thereof. Specific examples include various modified silicone oils described on pages 6 to 18B of the technical document "Modified Silicone Oil" published by Shin-Etsu Chemical Co., Ltd. Where they are used in an organic solvent type binder, an amino-modified silicone oil having a group capable of reacting with a crosslinking agent of this binder (for example, a group capable of reacting with an isocyanate) is effective; and where they are used by being emulsified and dispersed in a water-soluble binder, a carboxy-modified silicone oil (for example, X-22-3710 manufactured by Shin-Etsu Chemical Co., Ltd.) or an epoxy-modified silicone oil (for example, XF-100T manufactured by Shin-Etsu Chemical Co., Ltd.) is effective.

The layers of the heat transfer dye-providing material and the heat transfer image-receiving material each used in the present invention may be hardened with a hardener.

Where an organic solvent type polymer is hardened, the hardeners described in JP-A-61-199997 and JP-A-58-215398 can be used. In particular, an isocyanate type hardener is preferably used for a polyester resin.

In hardening a water-soluble polymer, the hardeners described in column 41 of U.S. Pat. No. 4,678,739, and JP-A-59-116655, JP-A-62-245261 and JP-A-1-18942 can be suitably used. Additional examples thereof are an aldehyde type hardener (e.g., formaldehyde), an aziridine type hardener, an epoxy type hardener (e.g.,

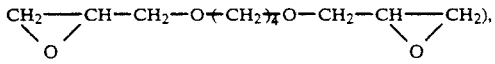

a vinylsulfone type hardener (e.g., N,N'-ethylene-bis(-vinylsulfonylacetamide)ethane), an N-methylol type hardener (e.g., dimethylol urea), and a polymer hardener (e.g., the compounds described in JP-A-62-234157).

An anti-fading agent may be present in the heat transfer dye-providing material and the heat transfer image-receiving material. Suitable examples of anti-fading agents are an anti-oxidation agent, a UV absorber and certain metal complexes.

Typical examples of anti-oxidation agents which can be used are chroman compounds, coumaran compounds, phenol compounds (e.g., hindered phenols), hydroquinone derivatives, hindered amine derivatives, and spiroindane compounds. Further, the compounds described in JP-A-61-159644 are effective as well.

Suitable examples of UV absorbers are benzotriazole compounds (U.S. Pat. No. 3,533,794), 4-thiazolidone compounds (U.S. Pat. No. 3,352,681), benzophenone compounds (JP-A-56-2784), and the compounds described in JP-A-54-48535, JP-A-62-136641 and JP-A-61-88256. Further, a UV absorptive polymer described in JP-A-62-260152 is also effective.

Examples of metal complexes are the compounds described in U.S. Pat. No. 4,241,155, columns 3 to 36 of U.S. Pat. No. 4,245,018, and columns 3 to 8 of U.S. Pat.

No. 4,245,195, and JP-A-62-174741, JP-A-61-88256 (pages 27 to 29), JP-A-1-75568, and JP-A-63-199248.

Examples of the useful anti-fading agents are described in JP-A-62-215272 (pages 125 to 137).

An anti fading agent is used to prevent the dye transferred to an image-receiving material from fading and it may be incorporated in advance into the image-receiving material or may be supplied to the image-receiving material externally by transfer from the dye-providing material.

The above described anti-oxidation agent, UV absorber and metal complex may be used as combinations, if desired.

Various surfactants can be used for the heat transfer dye-providing material and the heat transfer image-receiving material as a coating aid, to improve peeling properties and sliding properties, for anti-electrification and for promotion of development.

A nonionic surfactant, an anionic surfactant, an amphoteric surfactant and a cationic surfactant can be used. Typical examples thereof are described in JP-A-62-173463 and JP-A-62-183457.

Further, in dispersing a substance capable of receiving a heat migrating dye, a releasing agent, an anti-fading agent, a UV absorber, a fluorescent whitening agent, and other hydrophobic compounds in a water-soluble binder, a surfactant is preferably used as a dispersion aid. For this purpose, the surfactants described in JP-A-59-157636 (pages 37 to 38) can be particularly advantageously used in addition to the above surfactants.

A matting agent can be present in the heat transfer dye-providing material and the heat transfer image-receiving material. Typical examples of matting agents re the compounds described in JP-A-63-274944 and JP-A-63-274952, such as benzoguanamine resin beads, polycarbonate resin beads and styrene-acrylonitrile copolymer resin beads, in addition to the compounds described in JP-A-61-88256 (page 29), such as silicon dioxide, polyolefins and polymethacrylates.

As described above, the dye-providing material of the present invention is used to form a transferred image. This process comprises the steps of heating image-wise the dye-providing material with a laser and transferring a dye image to the image-receiving material to form a transferred image, as described above.

The dye-providing material of the present invention can be in a sheet form, a continuous roll or a ribbon, it contains only one kind of a dye, or has separately the areas containing the different dyes such as cyan and/or magenta and/or yellow and/or black and the other dyes. That is, materials including one color, two colors, three colors and four colors (or the materials of additional colors) are within the scope of the present invention.

In a preferred embodiment, the dye-providing material comprises a support of polyethylene terephthalate having coated thereon layers each containing a cyan dye, a magenta dye and a yellow dye in this order; and the above steps are carried out one by one as to each color to form a transferred image of the three colors. In carrying out this procedure for a single color, a monochromatic transferred image is obtained. For the purpose of heat-transferring a dye from the dye-providing material to the image-receiving material, several types of lasers such as an ion gas laser including argon and krypton lasers, a metal vapor laser including copper, gold and cadmium lasers, a solid laser including ruby and YAG lasers, and a semiconductor laser including a gallium arsenic laser emitting light in an infrared region of 750 to 870 nm can be used. Of these, a semiconductor layer is quite practical due to its small size, lower cost, stability, reliability, durability and ease of modulation. As a matter of fact, in order to use a laser for heating the dye-providing material, a laser ray has to be absorbed in a layer containing an infrared-absorbing dye and to be converted to heat through a molecular process known as an inner conversion. For this purpose, a laser which emits a light having a wavelength to be absorbed by the infrared-absorbing dye, preferably a wavelength of from about 750 nm to about 900 nm. The laser which emits a light of the above wavelength is known as an infrared laser and mainly can be selected from semiconductor lasers. Lasers which can be used for transferring a dye from the dye-providing material of the present invention are commercially available.

The invention is further illustrated by reference to the following examples.

EXAMPLE 1

Inks for forming the dye-providing layers with the following compositions were coated on a 6 μm thick support of a polyester film (manufactured by Teijin Limited) so that the coated amount thereof after drying became 1.2 g/m$^2$, whereby a dye-providing material was obtained.

Composition of Dye-Providing Layer-Forming Cyan Ink

| | |
|---|---|
| Compound 15 (infrared-absorbing dye) | 2.4 parts |
| Dye-a | 3 parts |

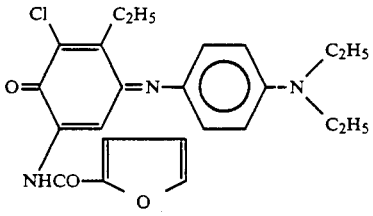

| | |
|---|---|
| Polyvinyl Butyral Resin (Denka Butyral 5000A, manufactured by Denki Kagaku Kogyo K.K.) | 2.5 parts |
| Polyisocyanate (Takenate D110N, manufactured by Takeda Chemical Industries, Ltd.) | 0.1 parts |
| Amino-Modified Silicone Oil (KF-857, manufactured by Shin-Etsu Chemical Co., Ltd.) | 0.004 part |
| Methyl Ethyl Ketone | 50 parts |
| Toluene | 50 parts |

Composition of Dye-Providing Layer-Forming Magenta Ink

| | |
|---|---|
| Compound 11 (infrared-absorbing dye) | 2.3 parts |
| Dye-b | 2.5 parts |

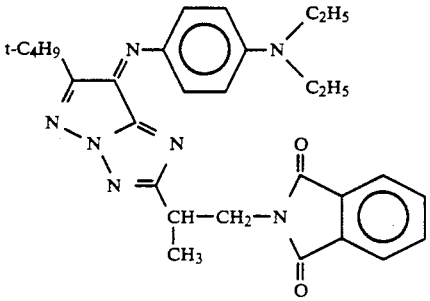

| | |
|---|---|
| Polyvinyl Butyral Resin | 2.5 parts |

-continued

| | |
|---|---|
| (S-Lec BX-1, manufactured by Sekisui Chemical Co., Ltd.) | |
| Polyisocyanate (KP-90, manufactured by Dainippon Ink and Chemicals, Inc.) | 0.1 parts |
| Silicone Oil (KF-857, manufactured by Shin-Etsu Chemical Co., Ltd.) | 0.004 part |
| Methyl Ethyl Ketone | 70 parts |
| Toluene | 30 parts |
| Composition of Dye-Providing Layer-Forming Yellow Ink | |
| Compound 25 (infrared-absorbing agent) | 2.5 parts |
| Dye-c | 5 parts |

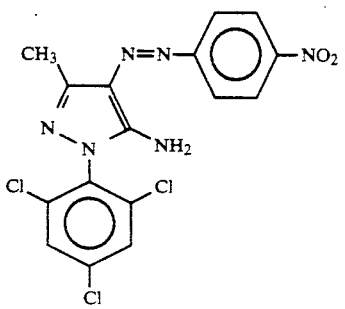

| | |
|---|---|
| Ethyl cellulose | 3 parts |
| Methyl Ethyl Ketone | 50 parts |
| Toluene | 50 parts |

Preparation of Heat Transfer Image-Receiving Material (1)

The image-receiving layer-coating components of the following composition were applied on a support of 150 μm thick synthetic paper (YUPO-FPG-150, manufactured by Oji Yuka Goseishi Co., Ltd.) using a wire-bar coating method so that he dry thickness was 8 μm, whereby Heat Transfer Image-Receiving Material (1) was prepared. After drying incompletely, the drying was carried out in an oven at 100° C. for 30 minutes.

| Image-Receiving Layer-Coating Components (1) | |
|---|---|
| Polyester Resin (Vylon-200, manufactured by Toyobo Co., Ltd.) | 22 g |
| Polyisocyanate (KP 90, manufactured by Dainippon Ink and Chemicals, Inc.) | 4 g |
| Amino-modified Silicone Oil (KF-857, manufactured by Shin-Etsu Chemical Co., Ltd.) | 0.5 g |
| Methyl Ethyl Ketone | 85 ml |
| Toluene | 85 ml |

The dye-providing material on a drum was superposed on the image-receiving material and was fixed with an adhesive tape. Then, this combined material was exposed to a focused laser light of 830 nm and dye was transferred to the dye-receiving material. The layer ray was emitted from a semiconductor laser device SDL-2420-H2 manufactured by Spectra Diode Lab Co., Ltd., in which the spot diameter and the irradiation time were 30 μm and 6 milliseconds, respectively, while the output was 85 mW.

The image formed on the image-receiving material was evaluated as described below. The dye-providing material containing the infrared absorbing material of the present invention formed a clear color image on the image-receiving material and no color stain due to the infrared-absorbing dye was observed. The maximum reflection densities measured with a Macbeth densitometer were 2.1 as a red color of a cyan image, 2.3 as a green color of a magenta image and 2.2 as a blue color of a yellow image, respectively.

EXAMPLE 2

The components for forming an infrared-absorbing layer having the following composition were coated on a polyethylene terephthalate-support in the thickness of 25 μm so that the dry thickness thereof became 1.5 μm, to thereby form the infrared-absorbing layer. Inks prepared by removing the infrared-absorbing dyes from the components for forming a dye-providing layer prepared in Example 1 were coated on this layer whereby yellow, magenta and cyan dye-providing material was prepared.

| Ink Composition for Forming Infrared-Absorbing Layer | |
|---|---|
| Compound 10 (infrared-absorbing dye) | 2.1 parts |
| Polyvinyl Butyral Resin (Denka Butyral 5000A, manufactured By Denka Kagaku Kogyo K.K.) | 2.5 parts |
| Methyl Ethyl Ketone | 70 parts |
| Toluene | 30 parts |

The dye-providing material thus obtained and the image-receiving material prepared in Example 1 were used to form a transferred image in the same manner as in Example 1. A laser diode SLD301 manufactured by Sony Corporation was used to emit a laser light.

The respective color images thus obtained were sharp. The maximum reflection densities measured with a Macbeth densitometer were 2.1 as a red color of a cyan image, 2.2 as a green color of a magenta image and 2.0 as a blue color of a yellow image.

EXAMPLE 3

Preparation of Heat Transfer Image-Receiving Material (2)

Polyethylene was coated on the both sides of a 200 μm thick paper in thicknesses of 15 μm and 25 μm, respectively, to thereby prepare a resin-coated paper. The image-receiving layer-coating components (2) of the following composition were coated on the 15 μm thick polyethylene-coated side of the support using a wire-bar coating method so that the dry thickness thereof became 10 μm, followed by drying, whereby Heat Transfer Dye-Receiving Material (2) was prepared.

| Image-Receiving Layer-Coating Components (2) | |
|---|---|
| Polyester Resin (TP 220, manufactured by The Nippon Synthetic Chemical Industry Co., Ltd.) | 25 g |
| Amino-Modified Silicone Oil (KF 857, manufactured by Shin-Etsu Chemical Co., Ltd.) | 0.8 g |
| Polyisocyanate (KP-90, manufactured by Dainippon Ink and Chemicals Inc.) | 4 g |
| Methyl Ethyl Ketone | 100 ml |
| Toluene | 100 ml |

The image-receiving material thus obtained and the dye-providing material prepared in Example 1 were used to form a transferred image in the same manner as in Example 1. The obtained image was sharp and had a high density.

EXAMPLE 4

Preparation of Heat Transfer Image-Receiving Material (3)

An organic solvent solution (B) of a dye-receptive polymer having the following composition was dispersed in an aqueous gelatin solution (A) of the following composition using a homogenizer, whereby a gelatin dispersion of a dye-receptive material was prepared.

| | |
|---|---|
| Aqueous Gelatin Solution (A) | |
| Gelatin | 2.3 g |
| Sodium Dodecylbenzenesulfonate (5% aqueous solution) | 20 ml |
| Water | 80 ml |
| Dye-Receptive Polymer Solution (B) | |
| Polyester Resin (Vylon 300 manufactured by Toyobo Co., Ltd.) | 7.0 g |
| Carboxy Modified Silicone Oil (X-22-3710, manufactured by Shin-Etsu Chemical Co., Ltd.) | 0.7 g |
| Methyl Ethyl Ketone | 20 ml |
| Toluene | 10 ml |
| Triphenyl Phosphate | 1.5 g |

The solution was prepared by dissolving a fluorinated surfactant (a)

$$C_3F_7SO_2\underset{\underset{C_3H_7}{|}}{N}CH_2COOK$$

0.5 g in 10 ml of a mixed solvent of water and methanol (1:1 by volume) was added to the dispersion thus prepared, to thereby prepare an image-receiving layer-coating composition.

This coating composition was applied to a 150 μm thick synthetic paper (YUPO-SGG-150 manufactured by Oji Yuka Goseishi Co., Ltd.), of which the surface had been subjected to a corona discharge, using a wire-bar coating method so that the wet thickness thereof was 75 μm, followed by drying, whereby Heat Transfer Dye-Receiving Material (3) was prepared.

The obtained Heat Transfer Dye-Receiving Material (3) and a dye-providing material prepared as in Example 2 were used to form a transferred image in the same manner as in Example 2. The obtained image was sharp and had a high density.

EXAMPLE 5

Inks for forming the dye-providing layers having the following compositions were coated on a 6 μm thick support of a polyester film, manufactured by Teijin Limited, in the coated amount of 1.2 g/m² after drying, whereby a dye-providing material was obtained.

| | |
|---|---|
| Composition of Dye-Providing Layer-Forming Cyan Ink | |
| Compound 40 (infrared-absorbing dye) | 2.0 parts |
| Dye-a | 3 parts |

-continued

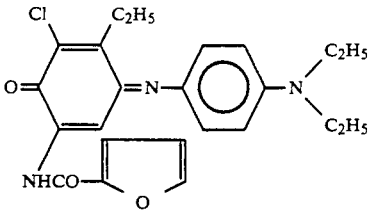

| | |
|---|---|
| Polyvinyl Butyral Resin (Denka Butyral 5000A, manufactured by Denki Kagaku Kogyo K.K.) | 2.5 parts |
| Polyisocyanate (Takenate D110N, manufactured by Takeda Chemical Industries, Ltd.) | 0.1 parts |
| Amino-Modified Silicone Oil (KF-857, manufactured by Shin-Etsu Chemical Co., Ltd.) | 0.004 part |
| Methyl Ethyl Ketone | 50 parts |
| Toluene | 50 parts |
| Composition of Dye-Providing Layer-Forming Magenta Ink | |
| Compound 37 (infrared-absorbing dye) | 2.1 parts |
| Dye-b | 2.5 parts |

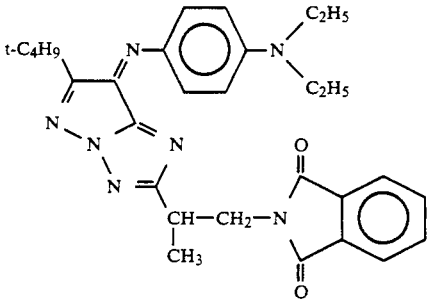

| | |
|---|---|
| Polyvinyl Butyral Resin (S-Lec BX-1, manufactured by Sekisui Chemical Co., Ltd.) | 2.5 parts |
| Polyisocyanate (KP-90, manufactured by Dainippon Ink and Chemicals, Inc.) | 0.1 parts |
| Silicone Oil (KF-857, manufactured by Shin-Etsu Chemical Co., Ltd.) | 0.004 part |
| Methyl Ethyl Ketone | 70 parts |
| Toluene | 30 parts |
| Composition of Dye-Providing Layer-Forming Yellow Ink | |
| Compound 43 (infrared-absorbing dye) | 2.0 parts |
| Dye-c | 5 parts |

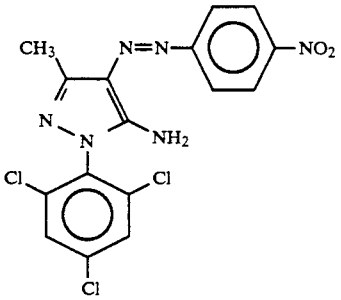

| | |
|---|---|
| Ethyl cellulose | 3 parts |
| Methyl Ethyl Ketone | 50 parts |
| Toluene | 50 parts |

Preparation of Heat Transfer Image-Receiving Material (4)

The image-receiving layer-coating components (3) of the following composition were applied to a support of 150 μm thick synthetic paper (YUPO-FPG-150, manufactured by Oji Yuka Goseishi Co., Ltd.) using a wire-bar coating method so that he dry thickness was 8 μm, whereby Heat Transfer Image-Receiving Material (4) was prepared. After drying incompletely, the drying was carried out in an oven at 100° C. for 30 minutes.

| Image-Receiving Layer-Coating Components (3) | |
|---|---|
| Polyester Resin (Vylon-200, manufactured by Toyobo Co., Ltd.) | 22 g |
| Polyisocyanate (KP-90, manufactured by Dainippon Ink and Chemicals, Inc.) | 4 g |
| Amino-modified Silicone Oil (KF-857, manufactured by Shin-Etsu Chemical Co., Ltd.) | 0.5 g |
| Methyl Ethyl Ketone | 85 ml |
| Toluene | 85 ml |

The dye-providing material provided on a drum was superposed on the image-receiving material and was fixed with an adhesive tape. Then, this combined material was exposed to a focused layer ray of 810 nm and the dye was transferred to the dye-receiving material. The laser light was emitted from a semiconductor laser device SDL-2420-H2 manufactured by Spectra Diode Lab Co., Ltd., in which the spot diameter and the irradiating time were 30 μm and 6 milliseconds, respectively, while the output was 85 mW.

The image formed on the image-receiving material was evaluated as follows.

The dye-providing material containing the compound of the present invention formed a clear color image on the image-receiving material and no color stain due to the infrared-absorbing dye was observed. The maximum reflection densities measured with a Macbeth densitometer were 2.0 as a red color of a cyan image, 2.1 as a green color of a magenta image and 1.9 as a blue color of a yellow image, respectively.

EXAMPLE 6

The components for forming an infrared-absorbing layer having the following composition were coated on a polyethylene terephthalate support in the thickness of 25 μm so that the dry thickness thereof was 1.5 μm, to thereby form the infrared-absorbing layer. Inks prepared by removing the infrared-absorbing dyes from the components for forming a dye-providing layer prepared as in Example 5 were coated on this layer whereby yellow, magenta and cyan dye-providing material was prepared.

| Ink Composition for Forming Infrared-Absorbing Layer | |
|---|---|
| Compound 41 (infrared-absorbing dye) | 2.5 parts |
| Polyvinyl Butyral Resin (Denka Butyral 5000A, manufactured By Denka Kagaku Kogyo K.K.) | 2.5 parts |
| Methyl Ethyl Ketone | 70 parts |
| Toluene | 30 parts |

The dye-providing material thus obtained and an image-receiving material prepared as in Example 5 were used to form a transferred image in the same manner as in Example 5. A laser diode SLD301 manufactured by Sony Corporation was used to emit the laser light.

The respective color images thus obtained were sharp. The maximum reflection densities measured with a Macbeth densitometer were 2.1 as a red color of a cyan image, 2.2 as a green color of a magenta image and 2.0 as a blue color of a yellow image.

EXAMPLE 7

Preparation of Heat Transfer Image-Receiving Material (5)

Polyethylene was coated on both sides of a 200 μm thick paper in a thickness of 15 μm and 25 μm, respectively, to thereby prepare a resin-coated paper. The image-receiving layer-coating components (4) of the following composition were coated on the 15 μm thick polyethylene-coated side of the support using a wire-bar coating method so that the dry thickness thereof was 10 μm, followed by drying, whereby Heat Transfer Dye-Receiving Material (4) was prepared.

| Image-Receiving Layer-Coating Components (4) | |
|---|---|
| Polyester Resin (TP-220, manufactured by The Nippon Synthetic Chemical Industry Co., Ltd.) | 25 g |
| Amino-Modified Silicone Oil (KF-857, manufactured by Shin-Etsu Chemical Co., Ltd.) | 0.8 g |
| Polyisocyanate (KP-90, manufactured by Dainippon Ink and Chemicals, Inc.) | 4 g |
| Methyl Ethyl Ketone | 100 ml |
| Toluene | 100 ml |

The image-receiving material thus obtained and the dye-providing material prepared as in Example 5 were used to form a transferred image in the same manner as in Example 5. The obtained image was sharp and had a high density.

EXAMPLE 8

Preparation of Heat Transfer Image-Receiving Material (6)

An organic solvent solution (D) of a dye-receptive polymer having the following composition was dispersed in an aqueous gelatin solution (C) of the following composition using a homogenizer, whereby a gelatin dispersion of a dye-receptive material was prepared.

| | |
|---|---|
| Aqueous Gelatin Solution (C) | |
| Gelatin | 2.3 g |
| Sodium Dodecylbenzenesulfonate (5% aqueous solution) | 20 ml |
| Water | 80 ml |
| Dye-Receptive Polymer Solution (D) | |
| Polyester Resin (Vylon 300 manufactured by Toyobo Co., Ltd.) | 7.0 g |
| Carboxy-Modified Silicone Oil (X-22-3710, manufactured by Shin-Etsu Chemical Co., Ltd.) | 0.7 g |
| Methyl Ethyl Ketone | 20 ml |
| Toluene | 10 ml |
| Triphenyl Phosphate | 1.5 g |

The solution was prepared by dissolving a fluorinated surfactant (a)

$$C_3F_7SO_2\underset{\underset{C_3H_7}{|}}{N}CH_2COOK$$

0.5 g in 10 ml of a mixed solvent of water and methanol (1:1 by volume) was added to the dispersion thus prepared, to thereby prepare an image-receiving layer-coating composition.

This coating composition was applied on a 150 μm thick synthetic paper (YUPO-SGG-150 manufactured by Oji Yuka Goseishi Co., Ltd.), of which the surface had been subjected to a corona discharge, using a wire bar coating method so that the wet thickness thereof was 75 μm, followed by drying, whereby Heat Transfer Dye-Receiving Material (6) was prepared.

The heat transfer dye-receiving material obtained and a dye-providing material prepared as in i 1 / Example 6 were used to form a transferred image in the same manner as in Example 6. The obtained image was sharp and had a high density.

While the invention has been described in detail and with reference to specific embodiments thereof, it will be apparent to one skilled in the art that various changes and modifications can be made therein without departing from the spirit and scope thereof.

What is claimed is:

1. A heat transfer dye-providing material comprising a support and having thereon a layer containing a heat migrating dye, wherein at least one of the dye-containing layer and a layer adjacent thereto contains an infrared-absorbing dye represented by the following Formula (I) or (II):

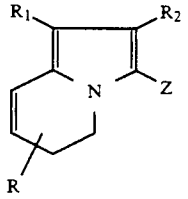

Formula (I)

wherein R represents a hydrogen atom, an alkyl group, an aryl group, an alkoxy group, a halogen atom, or a benzene ring condensed with a pyridine ring; $R_1$ represents an alkyl group or an aryl group; $R_2$ represents a hydrogen atom, an alkyl group, or an aryl group; and Z represents the group of atoms which have a nitrogen atom or an oxygen atom and complete a conjugate chain between the nitrogen atom of the picoline nucleus and the nitrogen atom or the oxygen atom contained in Z;

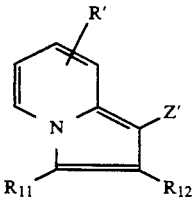

Formula (II)

wherein R' represents a hydrogen atom, a halogen atom, an alkyl group, an alkoxy group, an aryl group, or a benzene ring condensed with a pyridine ring; $R_{11}$ and $R_{12}$ represent independently a hydrogen atom, an alkyl group and an aryl group; and Z' represents the group of atoms which have a nitrogen atom or an oxygen atom and complete a conjugate chain between the nitrogen atom of the picoline nucleus and the nitrogen atom or the oxygen atom contained in Z'.

2. The heat transfer dye-providing material of claim 1, wherein the infrared-absorbing dye represented by the Formula (I) or (II) is a dye represented by the Formula (a), (b), (c), (d), (e) or (f):

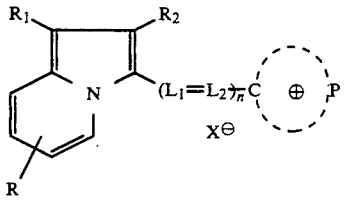

Formula (a)

wherein R, $R_1$ and $R_2$ each have the same meaning as R, $R_1$ and $R_2$, respectively, in Formula (I); $L_1$ and $L_2$ represent a methine group which may be substituted; n represents 1, 2 or 3; P represents the group of atoms necessary to form a hetero ring; and $X^{\ominus}$ represents an anion;

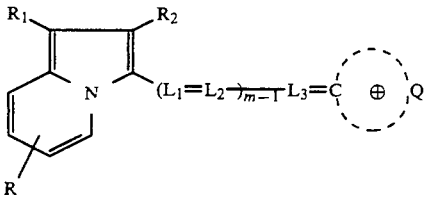

Formula (b)

wherein R, $R_1$ and $R_2$ each have the same meaning as R, $R_1$ and $R_2$, respectively, in Formula (I); $L_1$, $L_2$ and $L_3$ represent a methine group Which may be substituted; m represents 1, 2 or 3; and Q represents the group of atoms necessary to form a hetero ring;

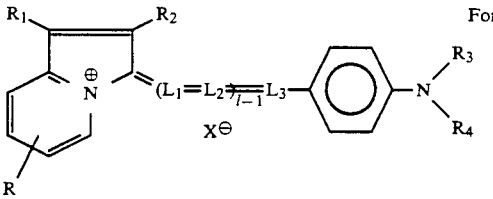

Formula (c)

wherein R, $R_1$ and $R_2$ each have the same meaning as R, $R_1$ and $R_2$, respectively, in Formula (I); $L_1$, $L_2$ and $L_3$ represent a methine group which may be substituted; l represents 1 or 2; $R_3$ and $R_4$ represent a hydrogen atom, an alkyl group or an aryl group; and $X^{\ominus}$ represents an anion;

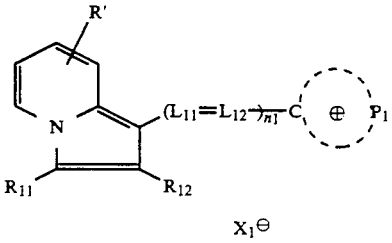

Formula (d)

wherein R', $R_{11}$ and $R_{12}$ each have the same meaning as R', $R_{11}$ and $R_{12}$ in Formula (II); $L_{11}$ and $L_{12}$ represent a methine group which may be substituted; $n_1$ represents 2 or 3; $P_1$ represents the group of atoms necessary to form a 5 to 6-membered hetero ring; and $X_1\ominus$ represents an anion;

Formula (e)

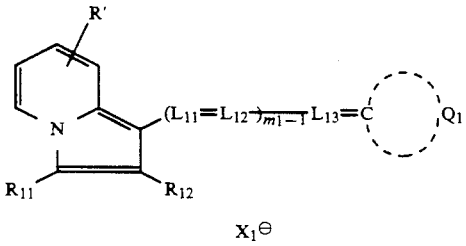

wherein R', $R_{11}$ and $R_{12}$ each have the same meaning as R', $R_{11}$ and $R_{12}$ in Formula (II); $L_{11}$, $L_{12}$ and $L_{13}$ represent a methine group Which may be substituted; $m_1$ represents 2 or 3; and $Q_1$ represents the group of atoms necessary to form a 5 to 6-membered hetero ring;

Formula (f)

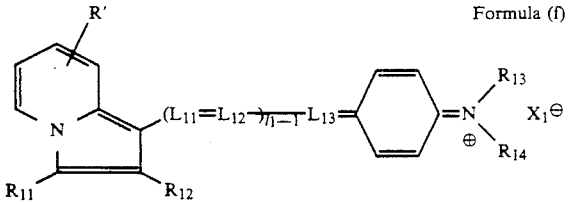

wherein R', $R_{11}$ and $R_{12}$ each have the same meaning as R', $R_{11}$ and $R_{12}$ in Formula (II); $L_{11}$, $L_{12}$ and $L_{13}$ represent a methine group which may be substituted; $l_1$ represents 2 or 3; $R_{13}$ and $R_{14}$ represent a hydrogen atom, an alkyl group or an aryl group; and $X_1\ominus$ represents an anion.

3. The heat transfer dye-providing material of claim 1, wherein said material includes a heat mobile dye-providing material.

4. The heat transfer dye-providing material of claim 3, wherein said material includes a heat mobile cyan dye-providing material.

5. The heat transfer dye-providing material of claim 3, wherein said material includes a heat mobile magenta dye-providing material.

6. The heat transfer dye-providing material of claim 3, wherein said material includes a heat mobile yellow dye-providing material.

* * * * *